US009741516B2

(12) United States Patent
Takahashi et al.

(10) Patent No.: US 9,741,516 B2
(45) Date of Patent: Aug. 22, 2017

(54) ELECTROMAGNETIC RELAY FOR VEHICLE

(75) Inventors: Toshio Takahashi, Kiryu (JP); Hiroyuki Mori, Kiryu (JP); Yoshiki Noro, Nasukarasuyama (JP); Tsutomu Fukui, Haga-gun (JP)

(73) Assignees: MITSUBA CORPORATION, Kiryu-Shi, Gunma (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/123,967

(22) PCT Filed: Jun. 22, 2012

(86) PCT No.: PCT/JP2012/066085

§ 371 (c)(1),
(2), (4) Date: Dec. 5, 2013

(87) PCT Pub. No.: WO2013/002154

PCT Pub. Date: Jan. 3, 2013

(65) Prior Publication Data

US 2014/0118097 A1 May 1, 2014

(30) Foreign Application Priority Data

Jun. 28, 2011 (JP) ..... 2011-142815

(51) Int. Cl.
*H01H 50/12* (2006.01)
*H01H 9/04* (2006.01)
(Continued)

(52) U.S. Cl.
CPC ..... *H01H 50/12* (2013.01); *H01H 9/047* (2013.01); *H01H 50/02* (2013.01); *H01H 50/023* (2013.01); *H01H 50/42* (2013.01)

(58) Field of Classification Search
CPC ..... H01H 50/12; H01H 50/023; H01H 50/02; H01H 9/047
(Continued)

(56) References Cited

U.S. PATENT DOCUMENTS 3,656,073 A 4/1972 Wood et al.
7,872,551 B2 * 1/2011 Nakamura et al. ..... 335/4
(Continued)

FOREIGN PATENT DOCUMENTS

CN 1224915 A 8/1999
CN 2706856 Y 6/2005
(Continued)

OTHER PUBLICATIONS

International Search Report dated Jul. 17, 2012 corresponding to International Patent Application No. PCT/JP2012/066085 and English translation thereof.
(Continued)

*Primary Examiner* — Bernard Rojas
(74) *Attorney, Agent, or Firm* — Squire Patton Boggs (US) LLP

(57) ABSTRACT

In an electromagnetic relay, terminal slits into which a coil terminal connected to a coil, a fixed contact terminal to which a fixed contact is attached, and a movable contact terminal electrically connected to a movable contact are inserted into is formed in a base, and the base is formed with ventilation holes used to discharge gas generated in an internal space and discharge vapor generated in the internal space. The ventilation holes are formed so as to be connected with the terminal slits.

3 Claims, 12 Drawing Sheets

(51) Int. Cl.
*H01H 50/02* (2006.01)
*H01H 50/42* (2006.01)

(58) Field of Classification Search
USPC ..... 335/78–86, 128
See application file for complete search history.

(56) References Cited

U.S. PATENT DOCUMENTS

| | | | | |
|---|---|---|---|---|
| 8,106,732 | B2 * | 1/2012 | Takano | 335/202 |
| 2005/0040920 | A1 * | 2/2005 | Takano et al. | 335/128 |
| 2010/0066471 | A1 | 3/2010 | Nagura et al. | |

FOREIGN PATENT DOCUMENTS

| | | | |
|---|---|---|---|
| CN | 201402758 | Y | 2/2010 |
| CN | 201608111 | U | 10/2010 |
| CN | 201608119 | U | 10/2010 |
| CN | 201663105 | U | 12/2010 |
| EP | 2 214 192 | A2 | 8/2010 |
| JP | 54-76940 | U | 5/1979 |
| JP | 58-5264 | U | 1/1983 |
| JP | S62-44922 | A | 2/1987 |
| JP | 3-79148 | U | 8/1991 |
| JP | H3-79149 | U | 8/1991 |
| JP | 4-25143 | U | 2/1992 |
| JP | 7-41943 | U | 7/1995 |
| JP | 2005203290 | A | 7/2005 |
| JP | 2007-323883 | A | 12/2007 |
| JP | 2010-040299 | A | 2/2010 |
| JP | 2010-108661 | A | 5/2010 |

OTHER PUBLICATIONS

European Search Report dated Feb. 13, 2015, for corresponding European Patent Appln. No. 12804091.2.

Japanese Notice of Allowance, with English language translation, dated Aug. 4, 2015, for corresponding Japanese Patent Application No. 2013-522827.

Chinese Office Action, with full English translation, dated Apr. 30, 2015, for corresponding Chinese Patent Application No. 201280030877.4.

European Search Report dated Nov. 24, 2016, issued in correspond EP Application No. 16185815.4.

Chinese Search Report dated May 4, 2017, issued in corresponding CN Application No. 201610058260.3. (with partial English Language translation).

* cited by examiner

ELECTROMAGNETIC RELAY FOR VEHICLE

TECHNICAL FIELD

The present invention relates to an electromagnetic relay mounted in, for example, a vehicle or the like.

Priority is claimed on Japanese Patent Application No. 2011-142815, filed Jun. 28, 2011, the content of which is incorporated herein by reference.

BACKGROUND ART

For example, an electromagnetic relay mounted in a vehicle or the like includes a base and a box-like cover having an opening at the base side. A sealed space is formed by the base and the cover. In the sealed space, a coil wound around a coil bobbin, an iron core inserted into the coil bobbin, a yoke which forms a magnetic path together with the iron core, a contact portion performing a switching operation based on magnetization and demagnetization of the iron core, and the like are disposed.

The contact portion includes a movable contact connected to a movable contact terminal and a fixed contact connected to a fixed contact terminal. The movable contact terminal and the fixed contact terminal protrude outward through slits formed in the base. Further, the movable contact terminal and the fixed contact terminal are connected to an external load.

In the above configuration, the movable contact comes in contact with (ON) or is separated from (OFF) the fixed contact based on magnetization or demagnetization of the coil. According to the ON or OFF operation of the contacts, an electric current of an external power source (not shown) is supplied to the load or the supply of the electric current is interrupted (for example, see Patent Literature 1).

Further, in an electromagnetic relay mounted in, for example, a vehicle, a contact portion and a coil magnetizing or demagnetizing an iron core are adjacently arranged on a base. Similarly, in this case, a contact portion includes a movable contact connected to a movable contact terminal and a fixed contact connected to a fixed contact terminal. The movable contact comes into contact with or is separated from the fixed contact based on magnetization or demagnetization of the coil.

Specifically, the movable contact is arranged on one end side of a movable contact plate of a flat spring, and the other end side of the flat spring is supported by a yoke which forms a magnetic path together with the iron core. A base end of the movable contact terminal is also attached to the yoke. As described above, the movable contact is connected with the movable contact terminal via the movable contact plate and the yoke. Further, the movable contact and the fixed contact are arranged in the separated state.

In this state, when an electric current is applied to the coil, the movable contact is attracted to and comes into contact with the fixed contact due to electromagnetic force generated in the coil, the fixed contact terminal is electrically connected with the movable contact terminal, and the electric current flows through the fixed contact terminal and the movable contact terminal. Meanwhile, when supply of the electric current to the coil is cut off, the movable contact is separated from the fixed contact according to an elastic operation of the flat spring in which the movable contact is arranged, and supply of the electric current to the fixed contact terminal and the movable contact terminal is stopped (for example, see Patent Literature 1).

CITATION LIST

Patent Literature

[Patent Literature 1]
Japanese Unexamined Patent Application, First Publication No. 2010-108661

SUMMARY OF INVENTION

Problem to be Solved by the Invention

However, in an electromagnetic relay mounted in a vehicle or the like, energy of arc discharge increases, which occurs between the contacts at the time of the ON or OFF operation of the contacts. For this reason, the amount of produced nitrogen oxide (NOx) increases compared to other resistive loads or capacitive loads. Generally, the coil bobbin is made of resin. For this reason, moisture absorbed into this resin is generated as vapor in the sealed space which is formed by the base and the cover when the electromagnetic relay operates. At this time, the nitrogen oxide reacts with the vapor, and thus nitric acid is generated in the sealed space.

Here, when the sealed space formed by the base and the cover is highly airtight, oxygen in the sealed space is consumed each time a load is disconnected, and arc energy gradually decreases as well. For this reason, nitrogen oxide production is also reduced, and accordingly nitric acid production is saturated after reaching a certain level.

However, in order to maintain the air tightness, it is necessary to employ a high-priced resin such as an LCP having low oxygen permeability for the base and the cover or to employ an adhesion technique capable of maintaining sealing around the movable contact terminal and the fixed contact terminal of the base. This is likely to increase the manufacturing cost of the electromagnetic relay.

Further, when air tightness is slightly broken, oxygen or moisture is supplied from the outside of the cover into the sealed space, and nitric acid production increases. This is likely to reduce the lifespan of the electromagnetic relay.

Further, in the above-mentioned related art, due to a shock which occurs when the movable contact comes into contact with the fixed contact, the movable contact plate rebounds, and a phenomenon called a bounce occurs, in which the movable contact comes into contact with and is separated from the fixed contact is repeated in a short period. The arc energy generated during the bounce promotes contact abrasion as the power-on operation and the power-off operation are repeated. As a result, the product lifespan of the electromagnetic relay is likely to be reduced.

The present invention has been made in light of the foregoing, and it is an object of the present invention to provide a low-priced electromagnetic relay with a long lifespan. Further, it is another object of the present invention to provide an electromagnetic relay capable of suppressing promotion of contact abrasion by suppressing the occurrence of the bounce and increasing the product lifespan.

Means for Solving the Problem

According to a first aspect of the present invention, an electromagnetic relay includes an iron core around which a coil is wound, and a fixed contact and a movable contact which perform a switching operation based on magnetization and demagnetization of the iron core, wherein the iron core, the fixed contact, and the movable contact are arranged in an internal space formed by a base and a cover attached to the base, and terminal slits into which a coil terminal connected to the coil, a fixed contact terminal to which the fixed contact is attached, and a movable contact terminal electrically connected to the movable contact are inserted are formed in the base. Further, the base is formed with a ventilation hole used to discharge gas generated in the internal space and discharge vapor generated in the internal space, and the ventilation hole is formed to be connected with the terminal slit.

As the ventilation hole is formed as described above, nitrogen oxide or vapor generated in the internal space can be discharged to the outside through the ventilation hole. In other words, as the internal space is formed to have a complete ventilation structure in communication with the outside, it is possible to prevent nitric acid from being generated by reaction of the nitrogen oxide and the vapor in the internal space. Thus, the air tightness of the internal space need not be maintained with a high degree of accuracy, and the lifespan of the electromagnetic relay can be increased at a low cost.

Further, the terminal slit can be easily formed together, and thus the manufacturing cost can be further reduced.

According to a second aspect of the present invention, in the electromagnetic relay according to the first aspect of the present invention, at least two ventilation holes are formed in the base.

According to the above configuration, the nitrogen oxide and the vapor generated in the internal space can be discharged reliably and rapidly.

According to a third aspect of the present invention, in the electromagnetic relay according to the first or second aspect of the present invention, the base is formed with a concave portion formed along an edge of the terminal slit, and, the ventilation hole is configured of an opening surrounded by the concave portion and the fixed contact terminal and the movable contact terminal inserted into the terminal slits in which the concave portion is formed.

As the ventilation hole is formed in the base, a member used in the related art can be used for each terminal, and productivity can be improved.

According to a fourth aspect of the present invention, in the electromagnetic relay according to the first or second aspect of the present invention, a concave portion is formed at a position corresponding to at least one terminal slit of the fixed contact terminal and the movable contact terminal, the ventilation hole is configured of an opening surrounded by the concave portion and an edge of the terminal slit.

As the ventilation hole is formed in each terminal as described above, conventional base member can be used, and thus productivity can be improved.

According to a fifth aspect of the present invention, in the electromagnetic relay according to any one of the first to fourth aspects of the present invention, the ventilation hole is formed to have an opening area size A satisfying $A \geq 1.4$ $mm^2$ and not to allow a spherical object having a diameter of 0.15 mm to pass through.

As described above, the opening area size A of the ventilation hole is set to satisfy $$A \geq 1.4 \text{ mm}^2 \quad (1)$$

and thus the nitrogen oxide and the vapor can be reliably discharged.

Further, since the ventilation hole is formed not to allow a spherical object having a diameter of 0.15 mm to pass through, invasion of ants into the internal space can be prevented.

Here, as a result of investigating ants having a smallest head in the world in order to prevent invasion of ants, an ant having a smallest head whose minimum width is larger than 0.15 mm has been found. Thus, as the ventilation hole formed in the base is formed not to allow a spherical object having a diameter of 0.15 mm to pass through, it is possible to prevent various ants from invading the internal space.

According to a sixth aspect of the present invention, in the electromagnetic relay according to any one of the first to fifth aspects of the present invention, the ventilation hole is formed in a rectangular form in a planar view, and a width W of the ventilation hole in a direction perpendicular to the longitudinal direction is set to satisfy $W<0.15$ mm.

According to the above configuration, the ventilation hole can be easily formed. In addition, the ventilation hole that does not allow a spherical object having a diameter of 0.15 mm to pass through can be easily formed.

Effects of Invention

According to the electromagnetic relay described above, the nitrogen oxide and the vapor generated in the internal space can be discharged to the outside through the ventilation hole. In other words, as the internal space is formed to have a complete ventilation structure in communication with the outside, it is possible to prevent nitric acid from being generated by reaction of the nitrogen oxide and the vapor in the internal space. Thus, the air tightness of the internal space need not be maintained with a high degree of accuracy, and the lifespan of the electromagnetic relay can be increased at a low cost.

Further, the terminal slit can be easily formed together, and thus the manufacturing cost can be further reduced.

DESCRIPTION OF EMBODIMENTS

First Embodiment (Electromagnetic Relay)

Next, a first embodiment of the present invention will be described with reference to the appended drawings.

Figure 1:
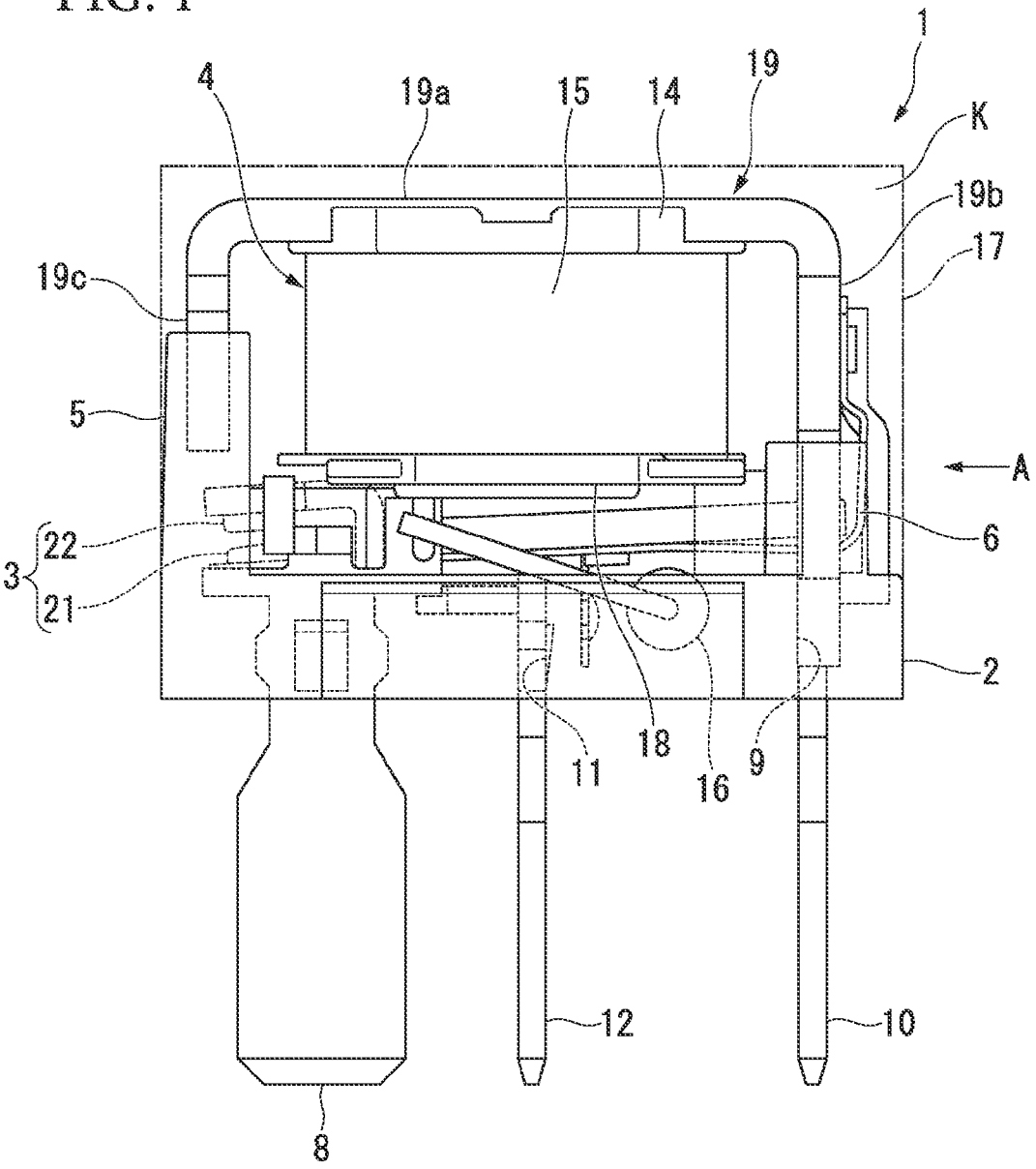
FIG. 1 is a side view of an electromagnetic relay according to a first embodiment of the present invention.
Figure 2:
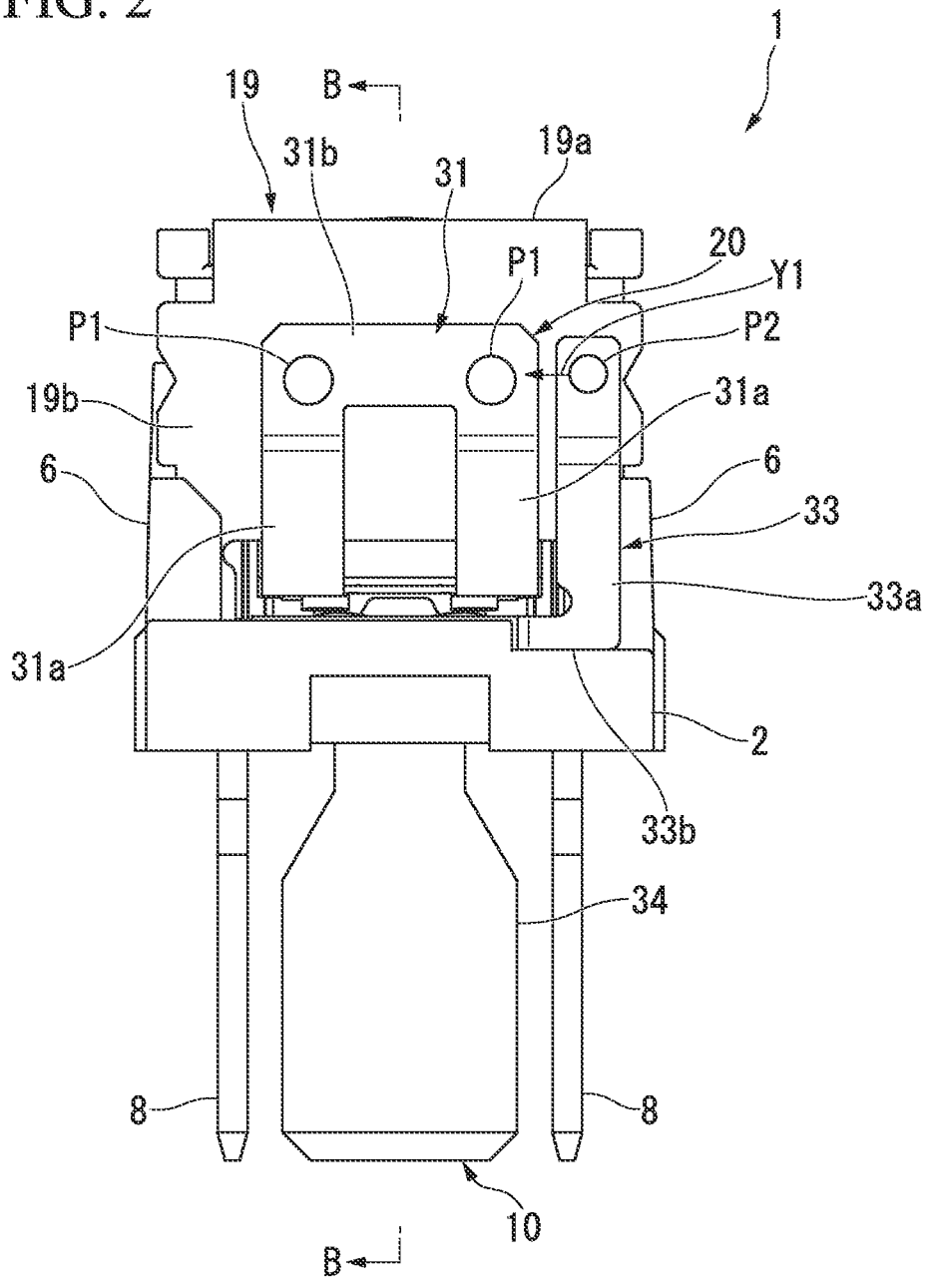
FIG. 2 is a view taken in a direction of an arrow A of FIG. 1.
Figure 3:
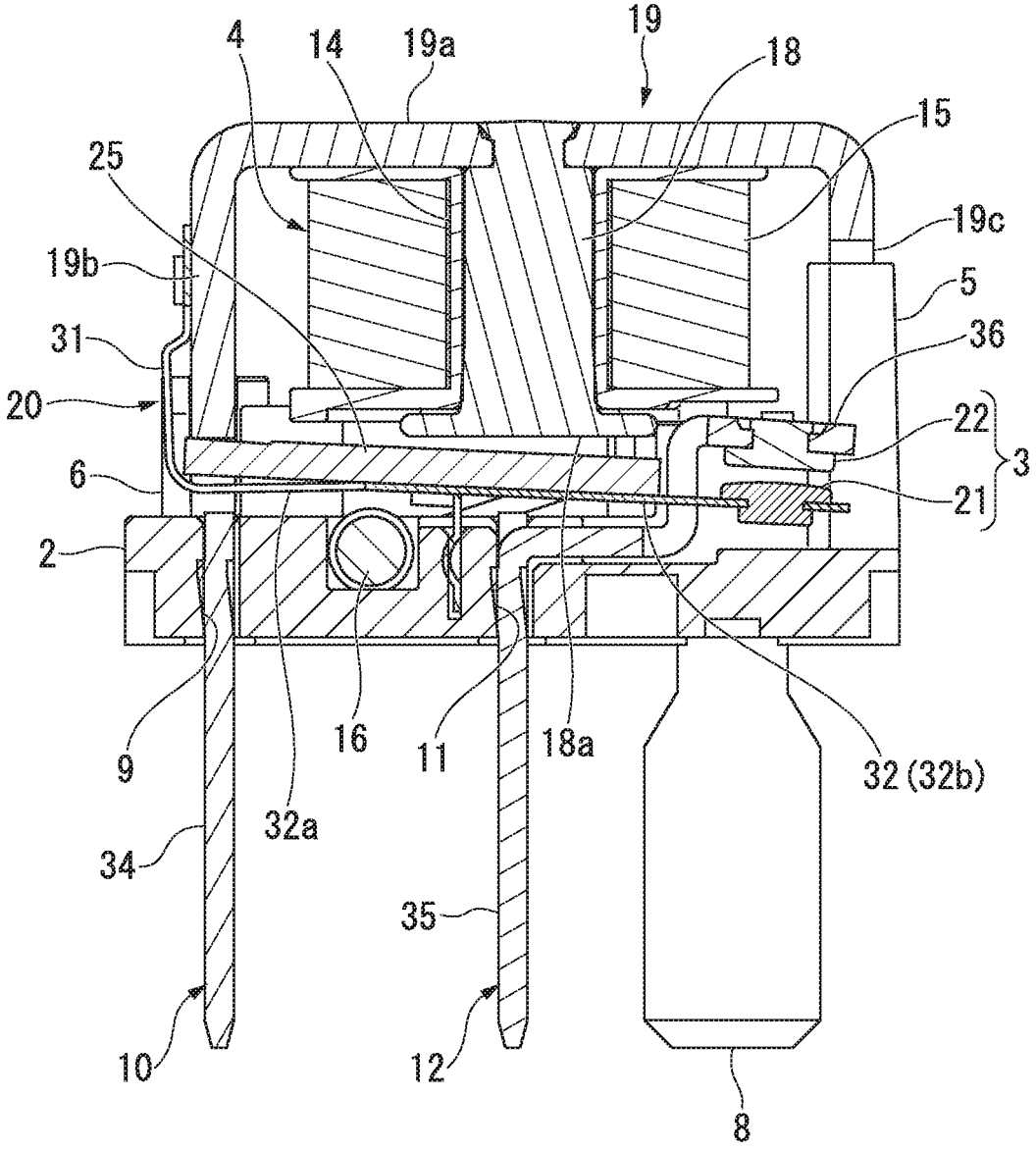
FIG. 3 is a cross-sectional view taken along line B-B of FIG. 2.
Figure 4:
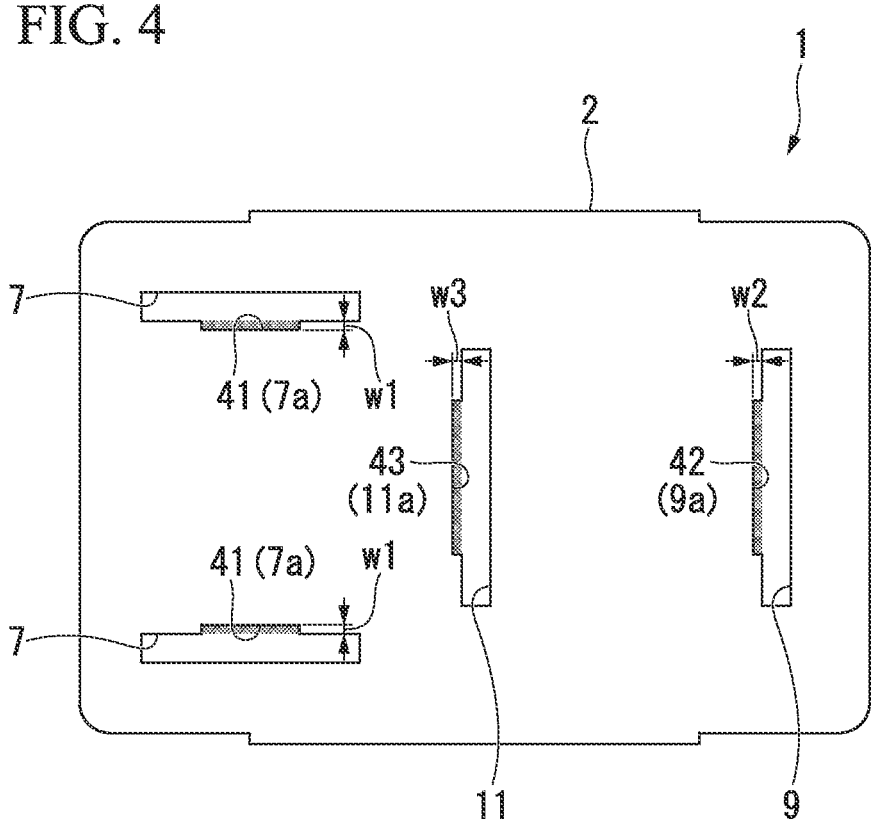
FIG. 4 is a planar view of a base according to the first embodiment of the present invention.

FIG. 1 is a side view of an electromagnetic relay 1, FIG. 2 is a view taken in a direction of an arrow A of FIG. 1, FIG. 3 is a cross-sectional view taken along line B-B of FIG. 2, and FIG. 4 is a planar view of a base 2.

For example, the electromagnetic relay 1 is a device used to turn on or off an inductive load such as a magnet clutch for an air conditioner mounted in a vehicle as illustrated in FIGS. 1 to 4. The electromagnetic relay 1 includes a base 2, a coil 4 arranged in an internal space K formed by the base 2 and a cover 17 attached to the base 2, and a contact portion 3 which is arranged between the base 2 and the coil 4 and configured with a movable contact 21 and a fixed contact 22.

As a contact material of the movable contact 21 and the fixed contact 22, for example, a silver-tin oxide-indium oxide-based contact is used for a contact at a side at which a positive pole is formed, and a silver-zinc oxide-based contact is used for a contact at a side at which a negative pole is formed.

The cover 17 is made of a resin having insulation properties and formed in a box shape having an opening at the base 2 side. The opening of the cover 17 is formed to correspond to an external form of the base 2, and the base 2 is attached so as to close the opening of the cover 17. The base 2 and the cover 17 are fixed by fitting or adhesion.

(Base)

The base 2 is made of a resin having insulation properties and formed in the form of an approximately rectangular flat plate. In one end side of the base 2 in the longitudinal direction (a left end in FIGS. 1 and 4 and a right end in FIG. 3), coil terminal slits 7 and 7 are formed on both sides in a direction perpendicular to the longitudinal direction. Each of the coil terminal slits 7 is formed in an approximately rectangular shape in a planar view to extend in the longitudinal direction of the base 2. Coil terminals 8 and 8 are inserted into the respective coil terminal slits 7 and 7 formed as described above.

Further, the coil terminal slit 7 is configured so that a gap is hardly formed between the coil terminal slit 7 and the coil terminal 8 in a state in which the coil terminal 8 is inserted into the coil terminal slit 7. The coil terminal 8 inserted into the coil terminal slit 7 protrudes from one side (underside in FIGS. 1 to 3) of the base 2. The coil 4 is connected to the coil terminal 8, and an electric current is supplied to the coil 4 through the coil terminal 8.

Further, a movable contact terminal slit 9 is formed in the other end side (a right end in FIGS. 1 and 4 and a left end in FIG. 3) of the base 2 in the longitudinal direction. The movable contact terminal slit 9 is formed in an approximately rectangular shape in a planar view to extend in the direction perpendicular to the longitudinal direction of the base 2. A movable contact terminal 10 which will be described below is inserted into the movable contact terminal slit 9 formed as described above.

Further, the movable contact terminal slit 9 is configured so that a gap is hardly formed between the movable contact terminal slit 9 and the movable contact terminal 10 in a state in which the movable contact terminal 10 is inserted into the movable contact terminal slit 9.

A fixed contact terminal slit 11 is formed at approximately the center of the base 2 in the longitudinal direction. The fixed contact terminal slit 11 is formed in an approximately rectangular shape in a planar view to extend in the direction perpendicular to the longitudinal direction of the base 2. A fixed contact terminal 12 which will be described below is inserted into the fixed contact terminal slit 11 formed as described above.

Further, the fixed contact terminal slit 11 is configured so that a gap is hardly formed between the fixed contact terminal slit 11 and the fixed contact terminal 12 in a state in which the fixed contact terminal 12 is inserted into the fixed contact terminal slit 11.

Here, in inner side edges of the terminal slits 7, 9, and 11, concave portions 7*a*, 9*a*, and 11*a* are formed to follow the inner side edges. The concave portions 7*a*, 9*a*, and 11*a* and openings surrounded by the respective terminals 8, 10, and 12 form ventilation holes 41 to 43. The respective ventilation holes 41 to 43 are configured to externally discharge the nitrogen oxide and the vapor generated in the internal space K formed by the base 2 and the cover 17 when the electromagnetic relay 1 operates. The respective ventilation holes 41 to 43 are formed in an approximately rectangular shape in a planar view in the longitudinal direction of the terminal slits 7, 9, and 11 formed as described above.

In other words, in the coil terminal slits 7 and 7, the ventilation holes 41 are formed in the inner side edges opposing each other. The ventilation hole 41 is formed in an approximately rectangular shape in a planar view along the longitudinal direction of the coil terminal slit 7.

Further, in the movable contact terminal slit 9, the ventilation hole 42 is formed in the inner side of the base 2 in the longitudinal direction. The ventilation hole 42 is formed in an approximately rectangular shape in a planar view along the longitudinal direction of the movable contact terminal slit 9.

Further, in the fixed contact terminal slit 11, the ventilation hole 43 is formed in the inner side of the side at which the coil terminal slit 7 is formed. The ventilation hole 43 is formed in an approximately rectangular shape in a planar view along the longitudinal direction of the fixed contact terminal slit 11.

Here, the respective ventilation holes 41 to 43 are formed so that widths W1 to W3 in the direction perpendicular to the longitudinal direction satisfy the following conditions:

$$W1<0.15\ \text{mm} \tag{2}$$

$$W2<0.15\ \text{mm} \tag{3}$$

$$W3<0.15\ \text{mm} \tag{4}$$

Further, a total opening area size Aa obtained by adding respective opening area sizes A (area sizes of hatched portions in FIG. 4) of the respective ventilation holes 41 to 43 is set to satisfy the following condition.

$$Aa\geq 1.4\ \text{mm}^2 \tag{5}$$

Further, in one end side of the base 2 in the longitudinal direction, a first support pillar 5 is formed to protrude toward a side (an upper side in FIGS. 1 and 3) opposite to a direction in which the respective terminals 8, 10, and 12 protrude. Further, in the other end side of the base 2 in the longitudinal direction, a second support pillar 6 is formed to protrude toward a side opposite to a direction in which the respective terminals 8, 10, and 12 protrude.

A yoke 19 formed to have an approximately L-shaped cross-section is supported by the first support pillar 5 and the second support pillar 6. The yoke 19 is configured to form a magnetic path and formed to be bent by press working on a metallic plate. The yoke 19 includes an upper wall 19*a* facing the base 2 with a certain gap therebetween, and a vertical wall 19*b* that is bent and extends in a direction approximately vertical to the upper wall 19*a* from an end of the upper wall 19*a* at the second support pillar 6 side. Further, the yoke 19 is formed so that a direction in which the upper wall 19*a* and the vertical wall 19*b* are connected increases.

Here, the first support pillar 5 arranged in the base 2 is formed to have an approximately C-shaped horizontal cross-section. Meanwhile, an engaging piece 19*c* insertable into the inside of the first support pillar 5 is bent and extends at an end of the upper wall 19*a* of the yoke 19 at the first support pillar 5 side. According to this configuration, one end of the yoke 19 is supported by the first support pillar 5.

On the other hand, the second support pillar 6 is arranged on both ends of the base 2 in the direction perpendicular to the longitudinal direction. The second support pillar 6 supports the vertical wall 19*b* of the yoke 19 to sandwich the vertical wall 19*b* from both ends in the direction perpendicular to the longitudinal direction.

An iron core 18 formed of a magnetic material in a rod form in the center is fixed to the upper wall 19*a* of the yoke 19. The iron core 18 is installed vertically from the upper wall 19*a* of the yoke 19 toward the base 2. The coil 4 is inserted from the outside and fixed to the iron core 18. In other words, the coil 4 is installed to be arranged on the base 2. Further, a flange portion 18*a* is formed on the front end of the iron core 18 to prevent the coil 4 from falling out of the iron core 18.

The coil 4 includes a coil bobbin 14 formed of resin having insulation properties in a tubular form and a coil wire 15 wound around the coil bobbin 14. The coil wire 15 is wound clockwise when viewed from the upper wall 19*a* side of the yoke 19 in the iron core 18. A winding start end and a winding end end of the coil wire 15 are connected to the coil terminal 8 by fusing. A register 16 is installed between the coil terminals 8 and 8 to straddle both terminals. The register 16 is a member which absorbs a reverse voltage of the coil 4.

Here, a movable contact spring 20 is attached to the vertical wall 19*b* of the yoke 19. The movable contact spring 20 is a member which supports the movable contact 21 forming one of the contact portion 3. The movable contact spring 20 is made of a flat spring material having conductivity and formed to have an approximately L-shaped cross-section. The movable contact spring 20 includes an attaching seat 31 attached to the vertical wall 19*b* of the yoke 19 and an operating piece 32 that is bent and extends from an end of the attaching seat 31 at the base 2 side to be interposed between the base 2 and the coil 4.

The attaching seat 31 is formed in a large part of the center of the vertical wall 19*b* of the yoke 19 in an approximately C shape in a planar view. In other words, the attaching seat 31 includes a pair of arm portions 31*a* and 31*a* that extend in the longitudinal direction and face each other in the direction perpendicular to the longitudinal direction, and a connecting unit 31*b* that extends to straddle end portions of the arm portions 31*a* and 31*a* at the side opposite to the base 2 and connects the arm portions 31*a* and 31*a*.

Welding points P1 are formed on both ends of the connecting unit 31*b* forming connecting portions with the arm portions 31*a* and 31*a*. The movable contact spring 20 is attached to the vertical wall 19*b* of the yoke 19 by performing spot welding or the like at the welding point P1.

The operating piece 32 includes support pieces 32*a* and 32*a* that are bent and extend from the front ends of the arm portions 31*a* and 31*a* and body portions 32*b* that extend from the front ends of the support pieces 32*a* and 32*a* and are formed to have a width at which the support pieces 32*a* and 32*a* are connectable. The movable contact 21 is attached to the front end of the body portion 32*b*. An iron piece 25 is installed on a surface of the body portion 32*b* at the coil 4 side. The operating piece 32 is installed so that the iron piece 25 is separated from the flange portion 18*a* of the iron core 18. Further, when the iron core 18 is magnetized as an electric current is applied to the coil wire 15, the operating piece 32 is elastically deformed, and the iron piece 25 is absorbed onto the iron core 18.

Further, the movable contact terminal 10 is attached to the vertical wall 19*b* of the yoke 19. The movable contact terminal 10 is a member in which an attaching seat 33 attached to the vertical wall 19*b* is molded integrally with an external connecting portion 34 that extends from the attaching seat 33 toward the side opposite to the yoke 19 while interposing the base 2.

The attaching seat 33 of the movable contact terminal 10 is formed in approximately an L shape in a planar view. In other words, the attaching seat 33 includes a first arm portion 33*a* that faces one of the two arm portions 31*a* and 31*a* of the attaching seat 31 forming the operating piece 32, that is, the arm portion 31*a* positioned at the right side in FIG. 2 in the direction perpendicular to the longitudinal direction of the vertical wall 19*b*. The first arm portion 33*a* is formed long along the longitudinal direction of the vertical wall 19*b*.

Further, a second arm portion 33*b* that is bent and extends to be approximately perpendicular to the first arm portion 33*a* is formed integrally with the front end of the first arm portion 33*a*.

The first arm portion 33*a* includes a welding point P2 that is set to the base end at the side opposite to the second arm portion 33*b*. The movable contact terminal 10 is attached to the vertical wall 19*b* of the yoke 19 by performing spot welding or the like at the welding point P2. Further, the external connecting portion 34 is connected to the front end of the second arm portion 33*b*.

The external connecting portion 34 is inserted into the movable contact terminal slit 9 formed on the base 2. According to this configuration, the external connecting portion 34 protrudes from a surface of the base 2 at the side opposite to the coil 4 and is electrically connected to a load (not shown, for example, a magnet clutch for an air conditioner).

Meanwhile, the fixed contact terminal 12 that is electrically connected to a load (not shown) together with the movable contact terminal 10 includes an external connecting unit 35 inserted into the fixed contact terminal slit 11. The base end of the external connecting unit 35 protrudes from the base 2 at the coil 4 side, and an internal contact portion 36 is bent from the protruding base end and extends toward the movable contact 21 side. The front end of the internal contact portion 36 is interposed between the movable contact 21 and the coil 4. The fixed contact 22 is attached to the front end of the internal contact portion 36. According to this configuration, the movable contact 21 and the fixed contact 22 are arranged to face each other with a certain gap therebetween.

(Operation of Electromagnetic Relay)

Next, an operation of the electromagnetic relay 1 will be described with reference to FIGS. 1 and FIGS. 4 to 6.

As illustrated in FIGS. 1 and 4, in the state in which an electric current is not applied to the coil wire 15 of the coil 4, the movable contact 21 and the fixed contact 22 forming the contact portion 3 are separated from each other.

Meanwhile, when an electric current is applied to the coil wire 15 through the coil terminal 8, the iron core 18 is magnetized.

When the iron core 18 is magnetized, an attractive force acts on the iron piece 25 installed in the movable contact spring 20 toward the iron core 18 side.

Thus, the movable contact spring 20 is elastically deformed, the iron piece 25 is adhered onto the iron core 18, and the movable contact 21 comes into contact with the fixed contact 22 (contact ON). As a result, the movable contact spring 20 is electrically connected with the fixed contact terminal 12 through the movable contact 21 and the fixed contact 22.

Since the movable contact spring 20 is electrically connected with the movable contact terminal 10 through the vertical wall 19*b* of the yoke 19, the movable contact terminal 10 is electrically connected with the fixed contact terminal 12. As a result, an electric current of an external power source (not shown) is supplied to a load (not shown, for example, a magnet clutch for an air conditioner).

Then, when supply of the electric current to the coil wire 15 is stopped again, the iron core 18 is demagnetized. As a result, the iron piece 25 is separated from the iron core 18 due to the elastic operation of the movable contact spring 20 (contact OFF). Thus, the movable contact 21 is separated from the fixed contact 22. Accordingly, the movable contact terminal 10 and the fixed contact terminal 12 are electrically disconnected, and supply of an electric current to a load (not shown) is stopped.

Here, there are cases in which arc discharge occurs between the fixed contact 22 and the movable contact 21 with the contact ON/OFF. Due to energy of the arc discharge, nitrogen oxide is generated in the internal space K formed by the base 2 and the cover 17. Further, as the electromagnetic relay 1 operates, moisture absorbed in the coil bobbin 14 made of a resin is generated in the internal space K as vapor. At this time, since the ventilation holes 41 to 43 are formed in the base 2, the nitrogen oxide and the vapor generated in the internal space K are discharged to the outside through the ventilation holes 41 to 43.

Here, since the total opening area size Aa obtained by the opening area sizes (area sizes of the hatched portions in FIG. 4) of the ventilation holes 41 to 43 is set to satisfy Formula (5), the nitrogen oxide and the vapor are reliably discharged.

Figure 5:
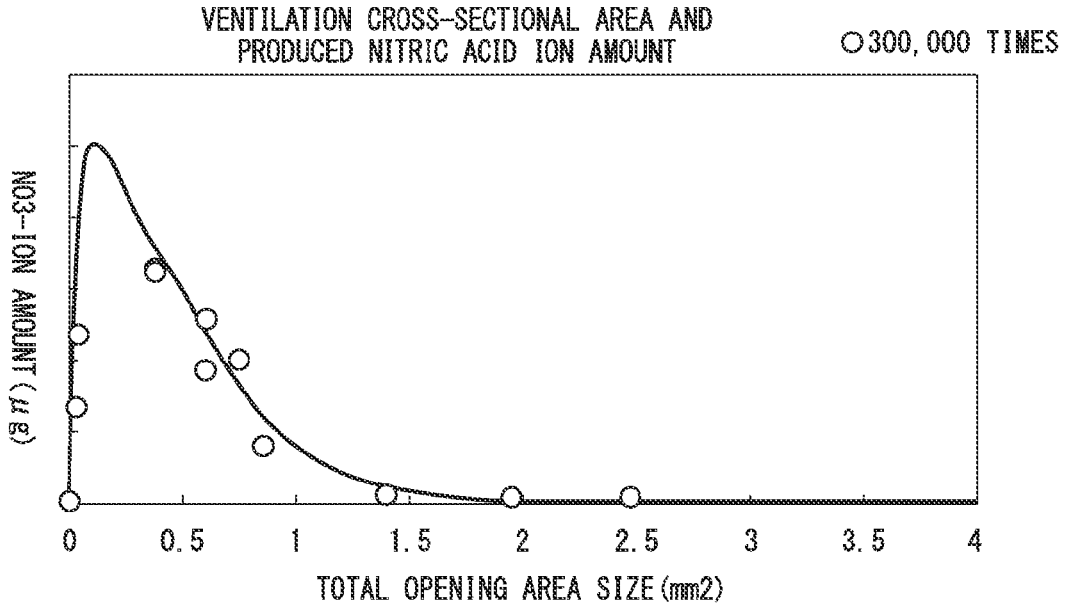
FIG. 5 is a graph illustrating a change in production of nitric acid ions according to the first embodiment of the present invention.
Figure 6:
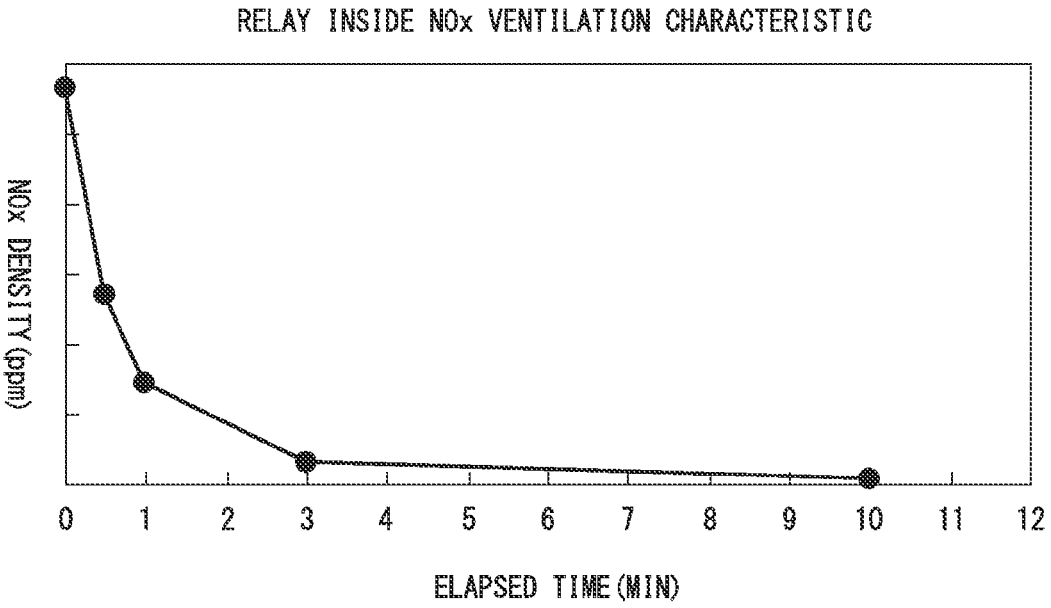
FIG. 6 is a graph illustrating a change in density of nitrogen oxide according to the first embodiment of the present invention.

A more detailed description will proceed with reference to FIGS. 5 and 6.

FIG. 5 is a graph illustrating a change in production of nitric acid ions when a vertical axis represents nitric acid ion production [m] generated as the nitrogen oxide reacts with the vapor in the internal space K of the electromagnetic relay 1, and a horizontal axis represents a total opening area size [$mm^2$] of the ventilation holes 41 to 43. FIG. 6 is a graph illustrating a change in the density of the nitrogen oxide when a vertical axis represents the density [ppm] of the nitrogen oxide (NOx), a horizontal axis represents an elapsed time [min], and the total opening area size [$mm^2$] of the ventilation holes 41 to 43 is 1.4 $mm^2$.

As illustrated in FIG. 5, when the total opening area size Aa of the ventilation holes 41 to 43 is 1.4 $mm^2$, the nitric acid ions are hardly generated in the internal space K.

This is because when the total opening area size Aa of the ventilation holes 41 to 43 is 1.4 $mm^2$, the nitrogen oxide generated in the internal space K of the electromagnetic relay 1 is rapidly discharged through the ventilation holes 41 to 43, and the nitrogen oxide barely remains in the internal space K three minutes after the nitrogen oxide is generated as illustrated in FIG. 6.

Here, when the ventilation holes 41 to 43 are formed in the base 2, ants are likely to invade through the ventilation holes 41 to 43. However, since the widths W1 to W3 of the ventilation holes 41 to 43 in the direction perpendicular to the longitudinal direction are set to satisfy Formulas (2) to (4) as illustrated in FIG. 4, invasion of ants can be prevented.

More specifically, as a result of investigating ants having the smallest heads in the world in order to prevent invasion of ants, ants having the smallest heads whose minimum width was larger than 0.15 mm were found. In other words, the ventilation holes 41 to 43 are formed not to allow a spherical object having a diameter of 0.15 mm to pass through, thus blocking ants from passing through the ventilation holes 41 to 43. In order to satisfy this condition, the ventilation holes 41 to 43 are formed in an approximately rectangular shape in a planar view, and the widths W1 to W3 in the direction perpendicular to the longitudinal direction are set to satisfy Formulas (2) to (4). Thus, it is possible to reliably prevent ants from invading the internal space K through the ventilation holes 41 to 43.

(Effects)

Therefore, according to the first embodiment, it is possible to reliably suppress generation of the nitric acid by reaction of the nitrogen oxide and the vapor in the internal space K formed by the base 2 and the cover 17. Further, the air tightness of the internal space K need not be maintained with a high degree of accuracy, and it is possible to increase the lifespan of the electromagnetic relay 1 at a low cost only by forming the ventilation holes 41 to 43.

Further, it is possible to prevent various ants from invading the internal space K through the ventilation holes 41 to 43, and it is possible to prevent the electromagnetic relay 1 from being damaged by invasion of ants. Accordingly, the lifespan of the electromagnetic relay 1 can be increased.

In addition, the respective ventilation holes 41 to 43 are formed in the respective terminal slits 7, 9, and 11. In other words, since the two or more ventilation holes 41 to 43 are formed, the nitrogen oxide or the vapor can be discharged reliably and rapidly.

The ventilation holes 41 to 43 are formed on the inner side edges of the respective terminal slits 7, 9, and 11 formed in the base 2. In other words, the respective ventilation holes 41 to 43 are formed in the respective terminal slits 7, 9, and 11 to communicate with one another. Thus, the manufacturing cost of the base 2 can be reduced in comparison with the case when the ventilation holes 41 to 43 are formed such that the respective terminal slits 7, 9, and 11 are separated.

Further, the respective terminal slits 7, 9, and 11 of the base 2 are formed in an approximately rectangular shape in a planar view to extend along the longitudinal direction of the base 2, and the widths W1 to W3 of the terminal slits 7, 9, and 11 in the direction perpendicular to the longitudinal direction are set to satisfy Formulas (2) to (4). Thus, the ventilation holes 41 to 43 have simple shapes, and it is possible to prevent ants from invading the internal space K through the ventilation holes 41 to 43.

The present invention is not limited to the first embodiment, and various changes can be made to the first embodiment within the scope not departing from the gist of the present invention.

For example, the first embodiment has been described in connection with the example in which the respective terminal slits 7, 9, and 11 of the base 2 are formed in an approximately rectangular shape in a planar view to extend along the longitudinal direction of the base 2, and the widths W1 to W3 of the terminal slits 7, 9, and 11 in the direction perpendicular to the longitudinal direction are set to satisfy Formulas (2) to (4). However, the present invention is not limited to this configuration, and the respective terminal slits 7, 9, and 11 need only be formed not to allow a spherical object having a diameter of 0.15 mm to pass through.

Here, when the respective terminal slits 7, 9, and 11 are in an approximately rectangular shape in a planar view, and the widths W1 to W3 in the direction perpendicular to the longitudinal direction are set to satisfy Formulas (2) to (4), a spherical object having a diameter of 0.15 mm hardly passes through the respective terminal slits 7, 9, and 11.

Further, the first embodiment has been described in connection with the example in which the ventilation holes 41 to 43 are formed to communicate with one another in the inner side edges of the respective terminal slits 7, 9, and 11 formed in the base 2. However, the present invention is not limited to this configuration, and the ventilation holes 41 to 43 may be formed at the position apart from the respective terminal slits 7, 9, and 11 of the base 2. Alternatively, the respective ventilation holes 41 to 43 may be formed in the respective terminal slits 7, 9, and 11, or at least one ventilation hole may be formed in the base 2.

In addition, instead of forming the respective ventilation holes 41 to 43 in the inner side edges of the respective terminal slits 7, 9, and 11 of the base 2, ventilation holes 141 to 143 may be formed in the base 2 such that concave portions 51 to 53 are formed in the coil terminal 8, the movable contact terminal 10, and the fixed contact terminal 12 inserted into the respective terminal slits 7, 9, and 11.

Modified Example

More specifically, a modified example of the ventilation holes 41 to 43 according to the first embodiment of the present invention will be described with reference to FIG. 7.

Figure 7:
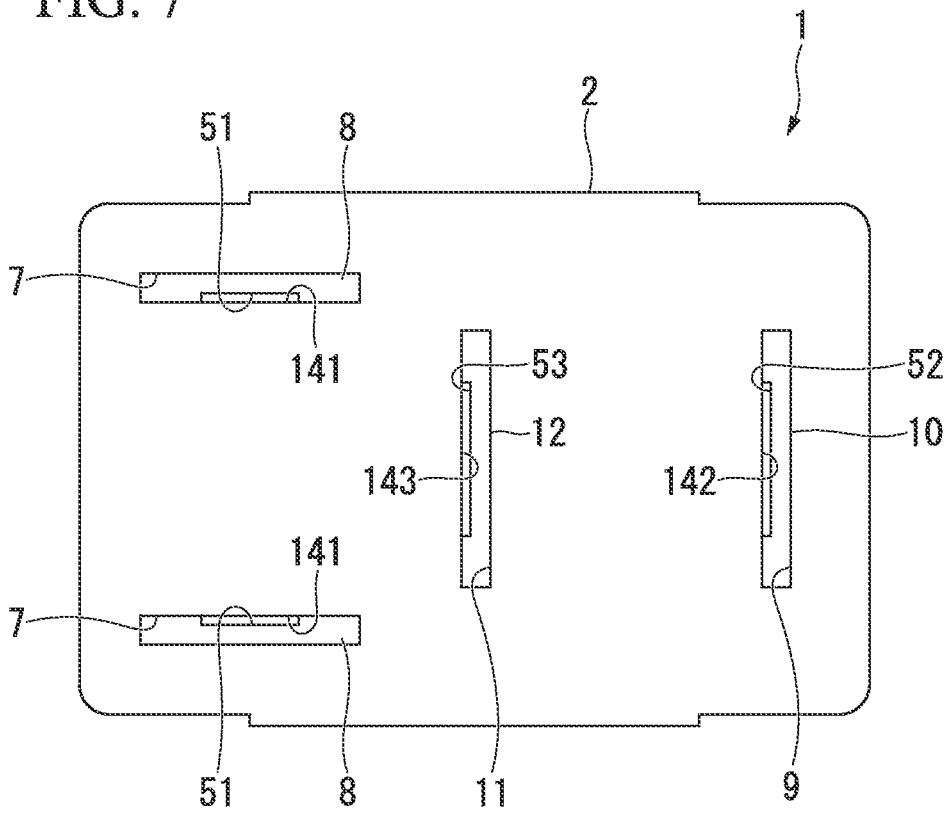
FIG. 7 is a planar view of a base illustrating a modified example of the electromagnetic relay according to the first embodiment of the present invention.

FIG. 7 is a plane view of the base 2 illustrating a modified example of the electromagnetic relay 1 according to the first embodiment of the present invention. In the following description, the same components as in the first embodiment are denoted by the same reference numerals, and a description thereof will be omitted.

As illustrated in FIG. 7, the coil terminal 8, the movable contact terminal 10, and the fixed contact terminal 12 are inserted into the respective terminal slits 7, 9, and 11 of the base 2.

Here, the concave portion 51 is formed in the insertion direction of the coil terminal 8 at the position corresponding to the coil terminal slit 7 of the coil terminal 8. An opening surrounded by the inner side edges of the concave portion 51 and the coil terminal slit 7 functions as the ventilation hole 141. In other words, the ventilation hole 141 is formed in the base 2.

Further, in the external connecting portion 34 of the movable contact terminal 10, the concave portion 52 is formed along the insertion direction of the external connecting portion 34 at the position corresponding to the movable contact terminal slit 9. An opening surrounded by the inner side edges of the concave portion 52 and the movable contact terminal slit 9 functions as the ventilation hole 142. In other words, the ventilation hole 142 is formed in the base 2.

Furthermore, in the external connecting unit 35 of the fixed contact terminal 12, the concave portion 53 is formed in the insertion direction of the external connecting unit 35 at the position corresponding to the fixed contact terminal slit 11. An opening surrounded by the inner side edges of the concave portion 53 and the movable contact terminal slit 9 functions as the ventilation hole 143. In other words, the ventilation hole 143 is formed in the base 2.

In the above configuration, the same effects as in the first embodiment are obtained.

(Electromagnetic Relay)

Next, a second embodiment of the present invention will be described with reference to the appended drawings.

Figure 8:
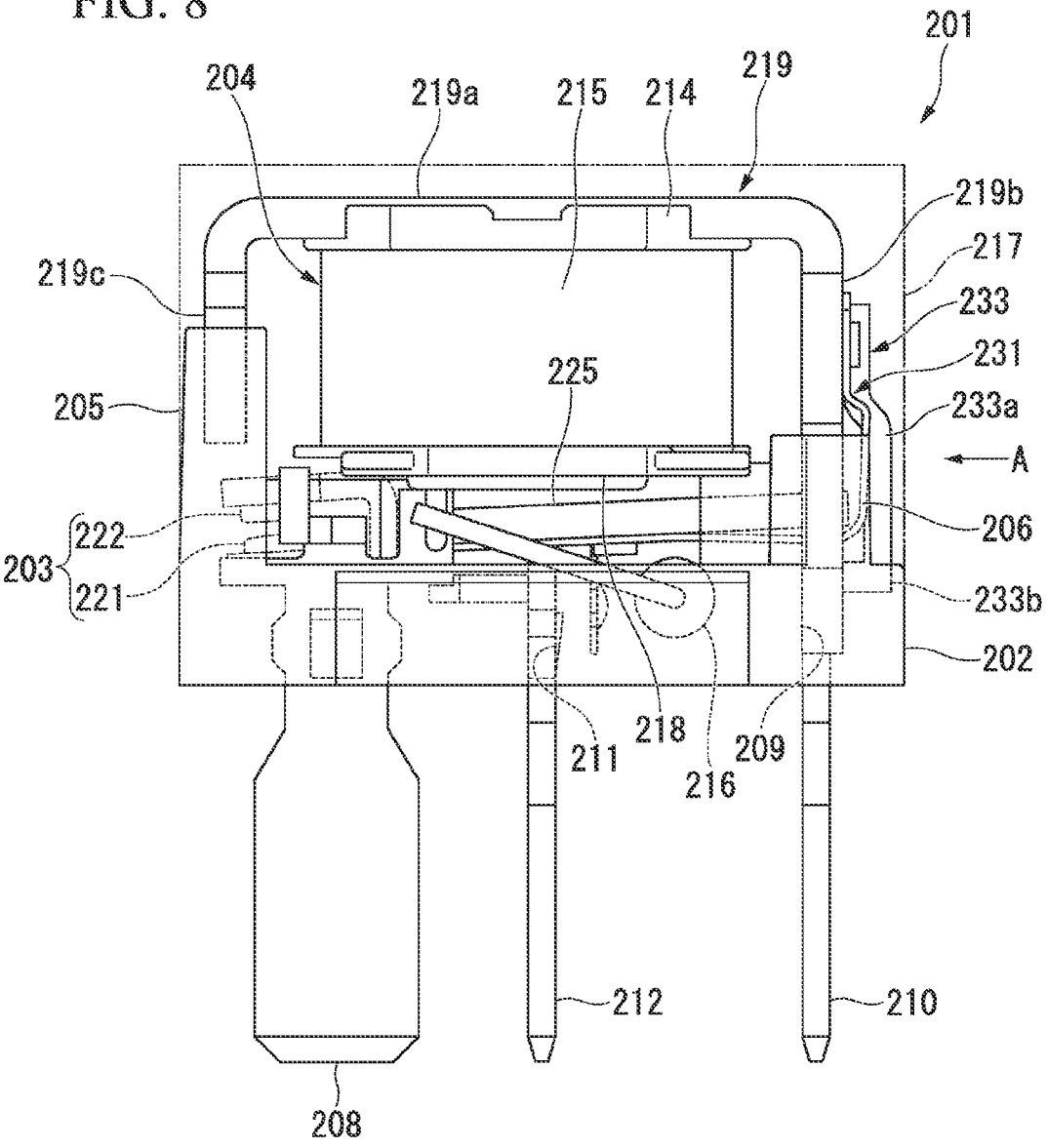
FIG. 8 is a side view of an electromagnetic relay according to a second embodiment of the present invention.
Figure 9:
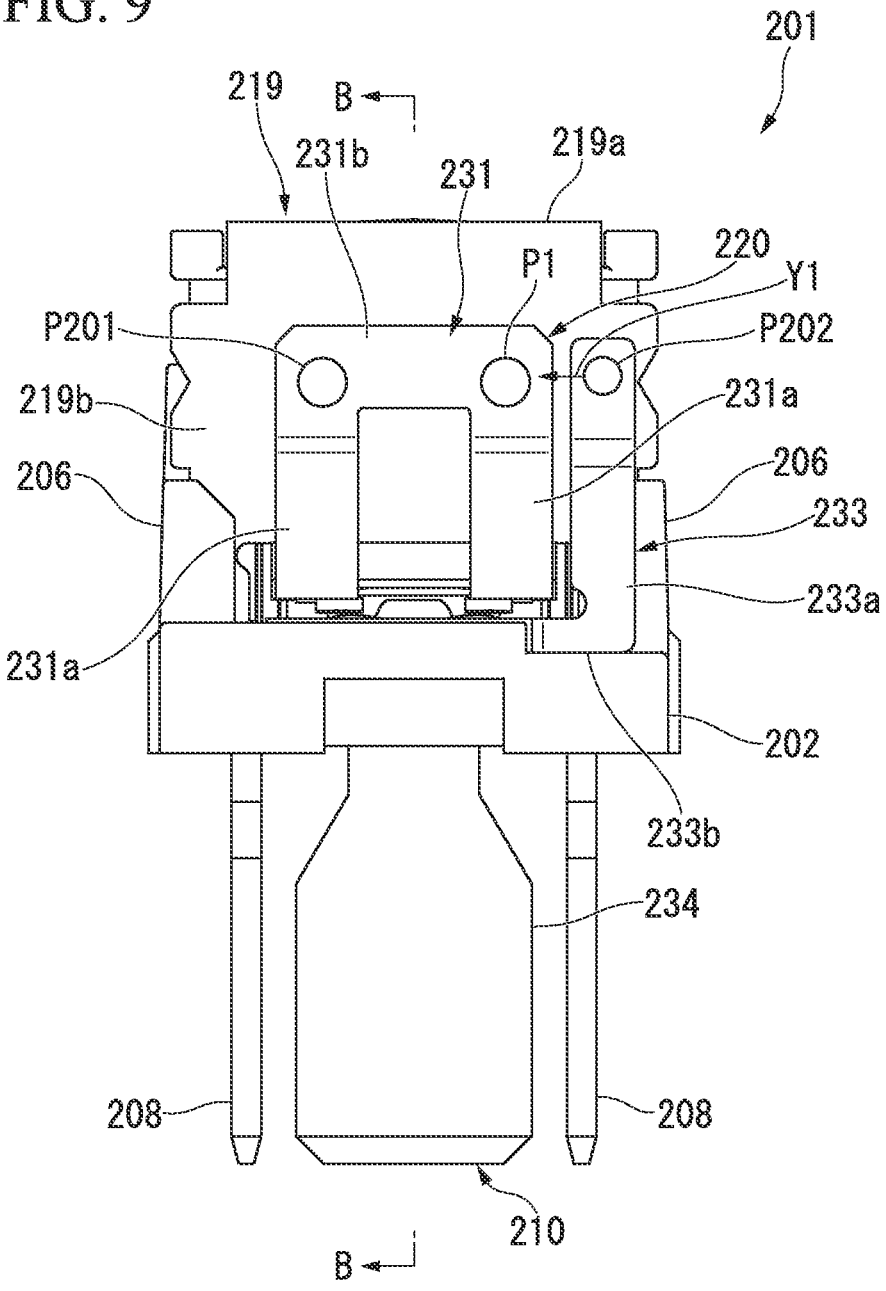
FIG. 9 is a view taken in a direction of an arrow A of FIG. 8.
Figure 10:
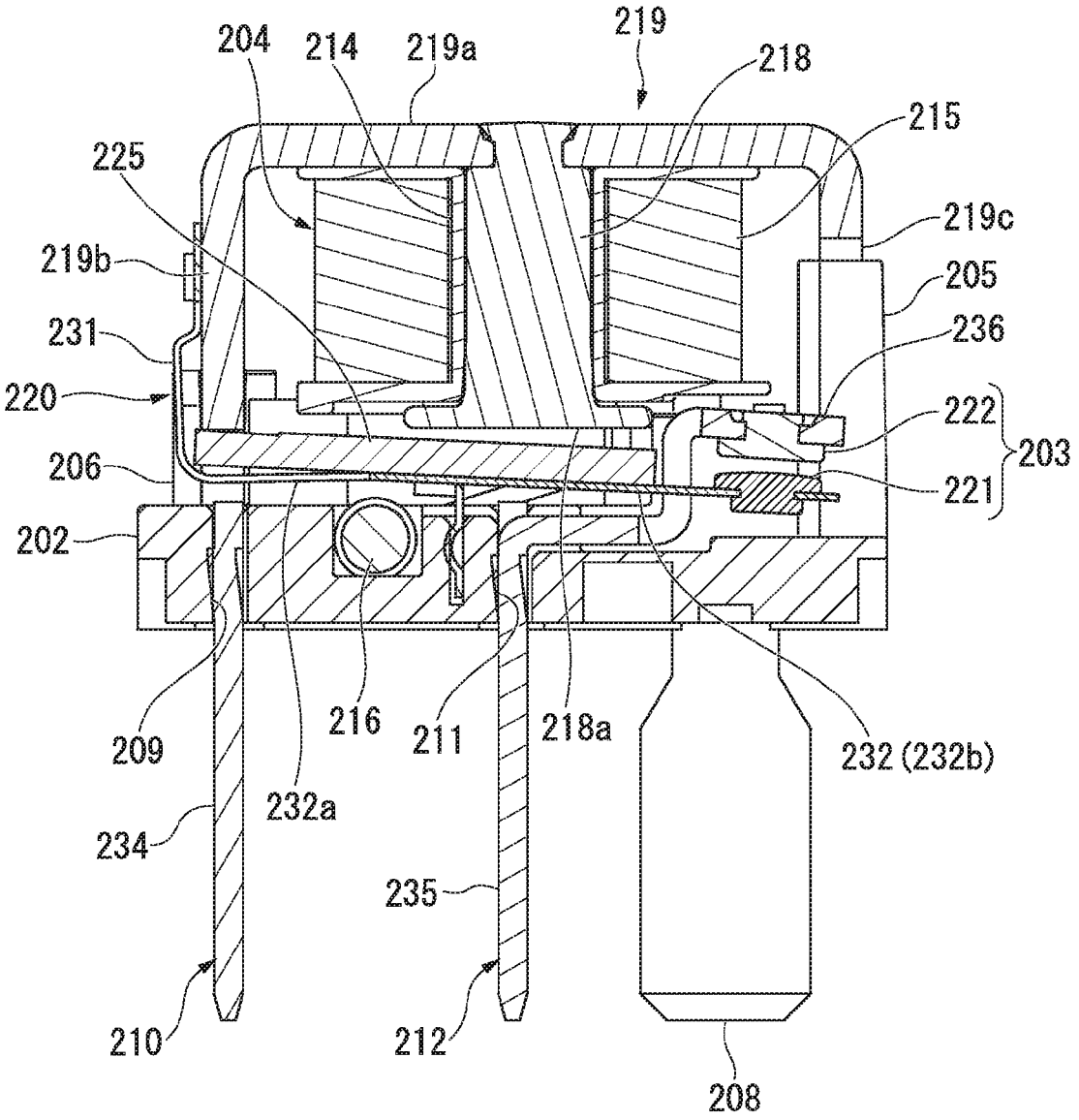
FIG. 10 is a cross-sectional view taken along line B-B of FIG. 9.

FIG. 8 is a side view of an electromagnetic relay 201, FIG. 9 is a view taken in a direction of an arrow A of FIG. 8, and FIG. 10 is a cross-sectional view taken along line B-B of FIG. 9.

For example, as illustrated in FIGS. 8 to 10, the electromagnetic relay 201 is a device used to turn on or off a lamp mounted in a vehicle. The electromagnetic relay 201 includes a coil 204 arranged on a base 202. Further, in the electromagnetic relay 201, a contact portion 203 configured with a movable contact 221 and a fixed contact 222 is arranged between the base 202 and the coil 204. The contact portion 203 and the coil 204 are covered with a cover 217.

The base 202 is made of a resin having insulation properties and formed in the form of an approximately rectangular flat plate. In one end side of the base 202 in the longitudinal direction (a left end in FIG. 8 and a right end in FIG. 10), coil terminal slits 207 and 207 are formed on both sides in the short direction. Coil terminals 208 and 208 are inserted into the coil terminal slits 207 and 207, and the respective coil terminals 208 and 208 protrude from one surface (underside in FIGS. 8 to 10) of the base 202. The coil 204 is connected to the coil terminal 208, and an electric current is supplied to the coil 204 through the coil terminal 208.

A first support pillar 205 is formed at one end side of the base 202 in the longitudinal direction to protrude toward the side (the upper side in FIGS. 8 and 10) opposite to the direction in which the respective terminals 208, 210, and 212 protrude. Further, a second support pillar 206 is formed at one end side of the base 202 in the longitudinal direction to protrude toward the side opposite to the direction in which the respective terminals 208, 210, and 212 protrude.

A yoke 219 formed to have an approximately L-shaped cross-section is supported by the first support pillar 205 and the second support pillar 206. The yoke 219 is configured to form a magnetic path and formed to be bent by performing press working on a metallic plate. The yoke 219 includes an upper wall **219*a* facing the base 202 with a certain gap therebetween, and a vertical wall 219*b* that is bent and extends in a direction approximately vertical to the upper wall 219*a* from an end of the upper wall 219*a* at the second support pillar 2066 side. Further, the yoke 219 is formed so that a direction in which the upper wall 219*a* and the vertical wall 219*b*** are connected increases.

Here, the first support pillar 205 arranged to be erected from the base 202 is formed to have an approximately C-shaped horizontal cross-section. Meanwhile, an engaging piece **19*c*** insertable into the inside of the first support pillar 205 is bent and extends at an end of the upper wall 219*a* of the yoke 219 at the first support pillar 205 side. According to this configuration, one end of the yoke 219 is supported by the first support pillar 205.

Meanwhile, the second support pillar 206 is arranged on both ends of the base 202 in the short direction. The second support pillar 206 supports the vertical wall 219*b* of the yoke 219 to sandwich the vertical wall 219*b* from both ends in the short direction.

An iron core 218 formed of a magnetic material in a rod form in the center is fixed to the upper wall 219*a* of the yoke 219. The iron core 218 is installed vertically from the upper wall 219*a* of the yoke 219 toward the base 202. The coil 204 is inserted from the outside and fixed to the iron core 218. In other words, the coil 204 is installed to be arranged on the base 202. Further, a flange portion 218*a* is formed on the front end of the iron core 218 to prevent the coil 204 from falling out of the iron core 218.

The coil 204 includes a coil bobbin 214 of a tubular form and a coil wire 215 wound around the coil bobbin 214. The coil wire 215 is wound clockwise when viewed the upper wall 219*a* side of the yoke 219 in the iron core 218. A winding start end and a winding end end of the coil wire 215 are connected to the coil terminal 208 by fusing. A register 216 is installed between the coil terminals 208 and 208 to straddle both terminals. The register 216 is a member for absorbing a reverse voltage of the coil 204.

Here, a movable contact spring 220 is attached to the vertical wall 219*b* of the yoke 219. The movable contact spring 220 is a member supporting the movable contact 221 forming one of the contact portion 203. The movable contact spring 220 is made of a flat spring material having conductivity and formed to have an approximately L-shaped cross-section. The movable contact spring 220 includes an attaching seat 231 attached to the vertical wall 219*b* of the yoke 219 and an operating piece 232 that is bent and extends from an end of the attaching seat 231 at the base 202 side to be interposed between the base 202 and the coil 204.

The attaching seat 231 is formed in a large part of the center of the vertical wall 219*b* of the yoke 219 in an approximately C shape in a planar view. In other words, the attaching seat 231 includes a pair of arm portions 231*a* and 231*a* that extend in the longitudinal direction and face each other in the short direction, and a connecting unit 231*b* that extends to straddle the ends portions of the arm portions 231*a* and 231*a* at the side opposite to the base 202 and connects the arm portions 231*a* and 231*a*.

Welding points P1 at which swaging or welding is performed are formed on both ends of the connecting unit 31*b* forming connecting portions with the arm portions 31*a* and 31*a*. The movable contact spring 220 is attached to the vertical wall 219*b* of the yoke 219 by performing spot welding or the like at the welding point P201.

The operating piece 232 includes support pieces 232*a* and 232*a* that are bent and extend from the front ends of the arm portions 231*a* and 231*a* and body portions 232*b* that extend from the front ends of the support pieces 232*a* and 232*a* and are formed to have a width at which the support pieces 232*a* and 232*a* are connectable. The movable contact 221 is attached to the front end of the body portion 232*b*. An iron piece 225 is installed on a surface of the body portion 232*b* at the coil 204 side. The operating piece 232 is installed so that the iron piece 225 is separated from the flange portion 218*a* of the iron core 218. Further, when the iron core 218 is magnetized as an electric current is applied to the coil wire 215, the operating piece 232 is elastically deformed, and the iron piece 225 is adhered onto the iron core 218 (the details will be described below).

Further, the movable contact terminal 210 is attached to the vertical wall 219*b* of the yoke 219. The movable contact terminal 210 is a member in which an attaching seat 233 attached to the vertical wall 219*b* is molded integrally with an external connecting portion 234 that extends from the attaching seat 233 toward the side opposite to the yoke 219 while interposing the base 202.

The attaching seat 233 of the movable contact terminal 210 is formed in approximately an L shape in a planar view. In other words, the attaching seat 233 includes a first arm portion 233*a* that faces one of the two arm portions 231*a* and 231*a* of the attaching seat 231 forming the operating piece 232, that is, the arm portion 231*a* positioned at the right side in FIG. 9 in the short direction of the vertical wall 219*b*. The first arm portion 233*a* is formed long in the longitudinal direction of the vertical wall 219*b*.

Further, a second arm portion 233*b* that is bent and extends to be approximately perpendicular to the first arm portion 233*a* is formed integrally with the front end of the first arm portion 233*a*.

The first arm portion 233*a* includes a welding point P202 that is used for swaging or welding and set to the base end at the side opposite to the second arm portion 233*b*. The movable contact terminal 210 is attached to the vertical wall 219*b* of the yoke 219 by performing spot welding or the like at the welding point P202. Further, the external connecting portion 234 is connected to the front end of the second arm portion 233*b*.

Here, a movable contact terminal slit 209 is formed at the other end side (a right end in FIG. 8 and a left end in FIG. 10) of the base 202 in the longitudinal direction. The external connecting portion 234 of the movable contact terminal 210 is inserted into the movable contact terminal slit 209. Through this configuration, the external connecting portion 234 of the movable contact terminal 210 protrudes from a surface of the base 2 at the side opposite to the coil 204.

A fixed contact terminal slit 211 is formed at approximately the center of the base 202 in the longitudinal direction. The fixed contact terminal 212 is inserted into the fixed contact terminal slit 211.

The fixed contact terminal 212 includes an external connecting portion 235 inserted into the fixed contact terminal slit 211. The base end of the external connecting portion 235 protrudes from the base 202 at the coil 204, and an internal contact portion 236 is bent from the protruding base end and extends toward the movable contact 21 side. The front end of the internal contact portion 236 is interposed between the movable contact 221 and the coil 204. The fixed contact 222 is attached to the front end of the internal contact portion 236. According to this configuration, the movable contact 221 and the fixed contact 222 are arranged to face each other with a certain gap therebetween.

(Operation of Electromagnetic Relay)

Next, an operation of the electromagnetic relay 201 will be described with reference to FIGS. 9, 10, 11A, and 11B.

Figure 11A:
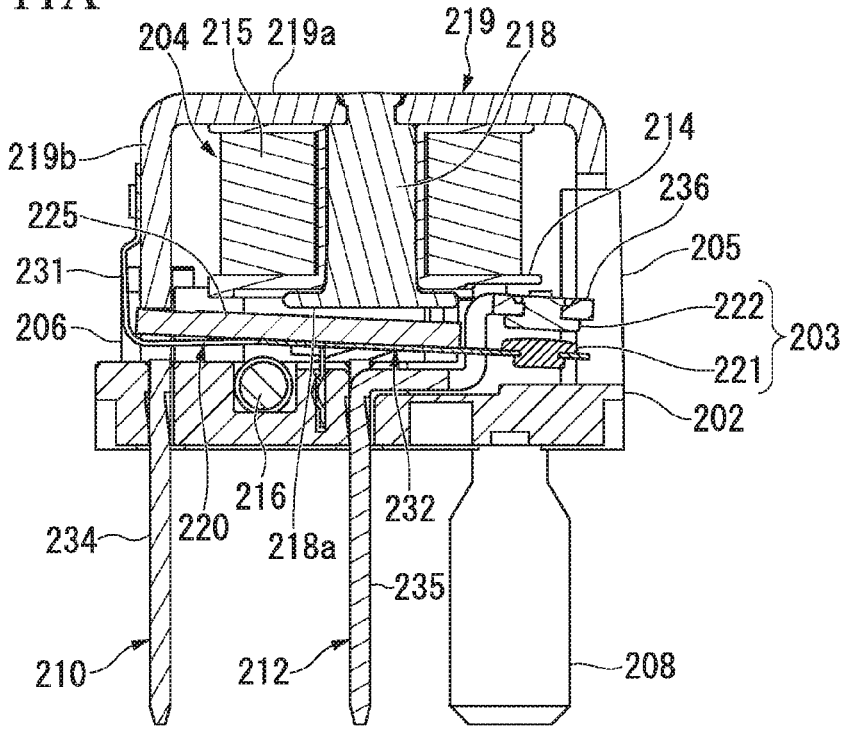
FIG. 11A is an explanatory diagram for describing an operation of the electromagnetic relay according to the second embodiment of the present invention in a state in which an electrical current is not supplied.
Figure 11B:
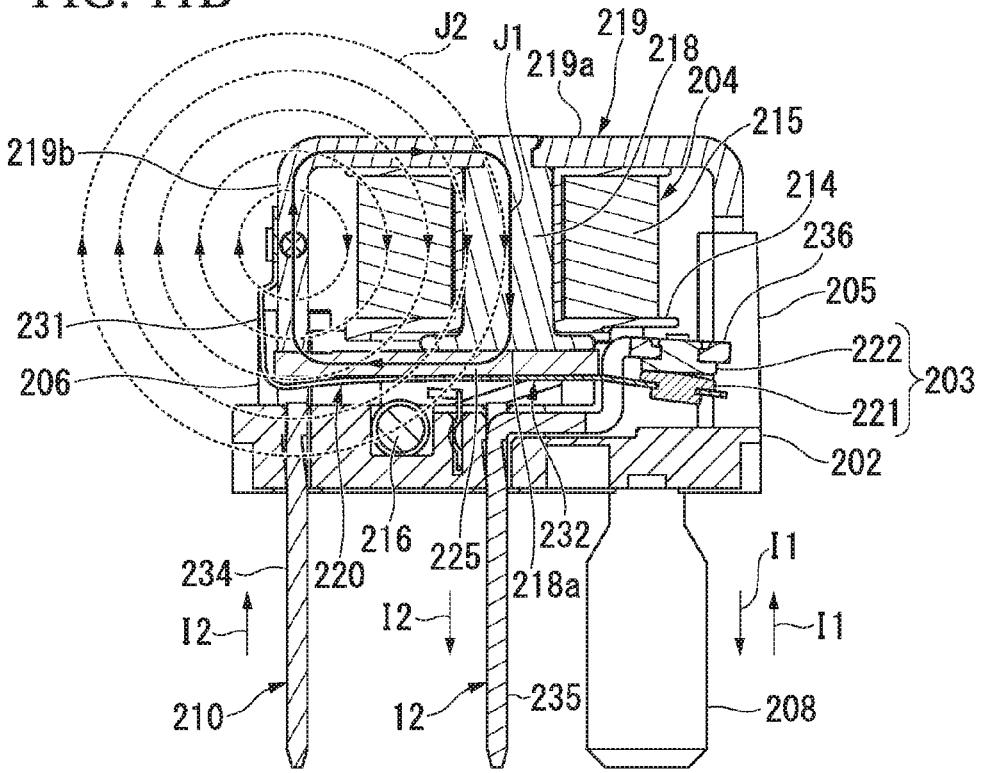
FIG. 11B is an explanatory diagram for describing an operation of the electromagnetic relay according to the second embodiment of the present invention in a state in which an electrical current is supplied.

FIGS. 11A and 11B are explanatory diagrams for describing an operation of the electromagnetic relay 201 and correspond to FIG. 10. FIG. 11A illustrates a state in which an electrical current is not applied to the coil wire 215 of the coil 204. FIG. 11B illustrates a state in which an electrical current is applied to the coil wire 215 of the coil 204.

As illustrated in FIG. 11A, in the state in which an electric current is not applied to the coil wire 215 of the coil 204, the movable contact 221 and the fixed contact 222 forming the contact portion 203 are separated from each other.

However, as illustrated in FIG. 11B, when an electric current I201 is supplied to the coil terminal 208 (hereinafter, an electric current supplied to the coil terminal 208 is referred to as a primary electric current), the electric current flows to the coil wire 215 through the coil terminal 208, and the iron core 218 is magnetized. At this time, the coil wire 215 is wound clockwise when viewed from the upper wall 219*a* side of the yoke 219 in the iron core 218. Thus, a direction of a magnetic field J1 formed as an electric current is supplied to the coil wire 215 is a direction from the upper wall 219*a* of the yoke 219 toward the flange portion 218*a* of the iron core 218.

When the iron core 218 is magnetized, an attractive force acts on the iron piece 225 installed in the movable contact spring 220 toward the iron core 218 side. Thus, the movable contact spring 220 is elastically deformed, the iron piece 225 is adhered onto the iron core 218, and the movable contact 221 comes into contact with the fixed contact 222. As a result, the movable contact spring 220 is electrically connected with the fixed contact terminal 212 through the movable contact 221 and the fixed contact 222. Since the movable contact spring 220 is electrically connected with the movable contact terminal 210 through the vertical wall 219*b* of the yoke 219, the movable contact terminal 210 is electrically connected with the fixed contact terminal 212. As a result, an electric current I202 of an external power source (not shown) is supplied to a load (not shown, for example, a lamp). In the following description, an electric current supplied to the movable contact terminal 210 and the fixed contact terminal 212 is referred to as a secondary electric current.

Here, a direction of the secondary electric current will be described in detail with reference to FIGS. 9 and 11B.

As illustrated in FIGS. 9 and 11B, when the movable contact terminal 210 is electrically connected with the fixed contact terminal 212, an electric current flows from the movable contact terminal 210 to the fixed contact terminal 212 through the movable contact spring 220. At this time, the movable contact terminal 210 and the movable contact spring 220 are arranged to face each other in the short direction of the vertical wall 219*b* of the yoke 219. Thus, in FIG. 9, an electric current flows from the right toward the left, that is, from the welding point P202 toward the welding point P201 (see an arrow Y1 in FIG. 9). In FIG. 11B, an electric current flows from the front toward the rear on a plane of paper on the vertical wall 219*b* of the yoke 219.

In other words, as an electric current is supplied to the movable contact terminal 210 and the fixed contact terminal 212, a magnetic field J2 is generated on the vertical wall 219*b* of the yoke 219 clockwise in FIG. 11B.

Here, the magnetic field J2 is the same in the direction as the magnetic field J1 generated on the iron core 218 as an electric current is supplied to the coil wire 215. For this reason, the magnetic field J2 overlaps the magnetic field J1. Thus, an attractive force on the iron piece 225 of the magnetized iron core 218 increases.

A change in magnetic force will be described in detail with reference to FIG. 12.

Figure 12:
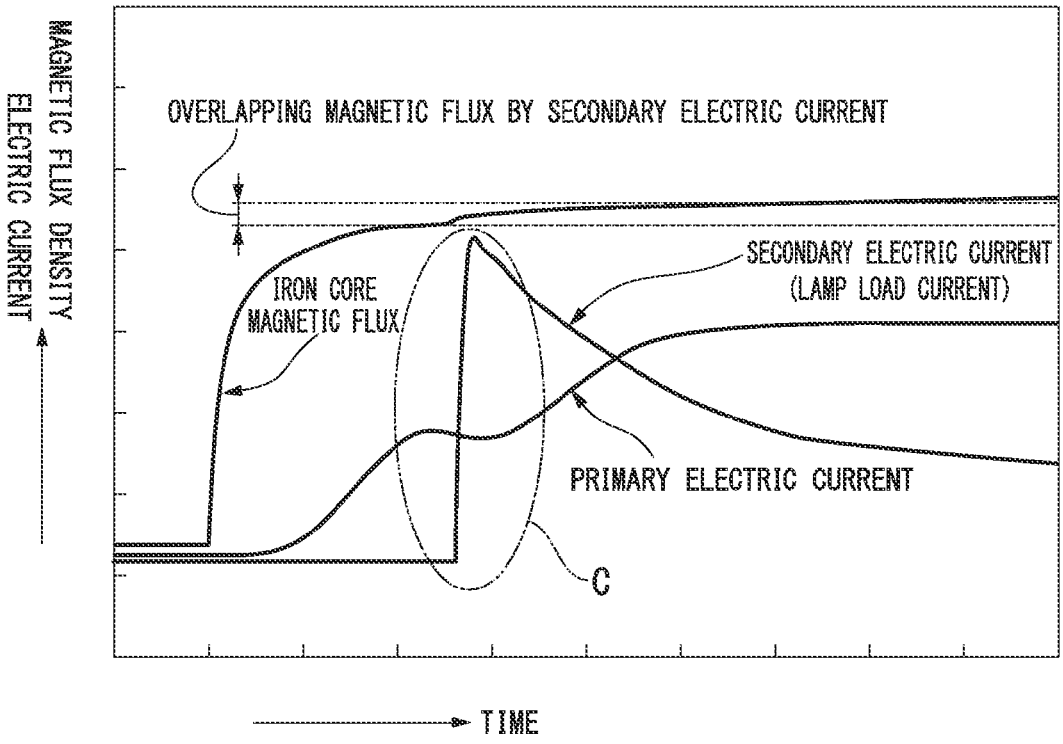
FIG. 12 is a graph illustrating a change in a primary electric current, a secondary electric current, and magnetic flux according to the second embodiment of the present invention.

FIG. 12 is a graph illustrating a change in the primary electric current, the secondary electric current, and magnetic flux when a vertical axis represents the primary electric current, the secondary electric current, and the magnetic flux density of the magnetic field J1 generated in the iron core 218, and a horizontal axis represents time.

As illustrated in FIGS. 11B and 12, when the primary electric current is supplied to the coil wire 215, the magnetic field J1 is generated in the iron core 218. The magnetic flux density of the magnetic field J1 abruptly increases after the primary electric current is supplied. Then, when the magnetic flux density of the magnetic field J1 approaches a certain value, the increase rate of the magnetic flux density abruptly decreases. When the magnetic flux density of the magnetic field J1 almost reaches a certain value, the iron piece 225 is absorbed onto the iron core 218 due to an attractive force to the iron piece 225 of the iron core 218.

As a result, the movable contact 221 comes into contact with the fixed contact 222, and the secondary electric current is supplied to the movable contact terminal 210 and the fixed contact terminal 212. At this time, the secondary electric current causes the magnetic field J2 to be generated on the vertical wall 219*b* of the yoke 219, and the magnetic field J2 overlaps the magnetic field J1.

Here, in further detail, when a moment of the beginning of the secondary electric current occurs in the middle of the beginning of the primary electric current, since a magnetic circuit is saturated by the primary electric current, the magnetic field J2 caused by the secondary electric current overlaps the magnetic field J1 caused by the primary electric current. At this time, as the magnetic field J1 overlaps the magnetic field J2, the primary electric current decreases (see a C section in FIG. 12).

As the magnetic field J2 overlaps the magnetic field J1 as described above, the magnetic flux density of the magnetic field generated in the iron core 218 has a value obtained by adding the magnetic flux density of the magnetic field J2 to the magnetic flux density of the magnetic field J1. Thus, by a degree to which the magnetic field J2 overlaps, the magnetic force generated in the iron core 218 increases, and the attractive force on the iron piece 225 increases. Thus, the iron piece 225 is reliably absorbed onto the iron core 218, and the movable contact 221 reliably comes into contact with the fixed contact 222.

Then, when the supply of the primary electric current is interrupted again, the iron core 218 is demagnetized. As a result, the iron piece 225 is separated from the iron core 218 by the elastic operation of the movable contact spring 220. Thus, the movable contact 221 is separated from the fixed contact 222. Accordingly, the movable contact terminal 210 and the fixed contact terminal 212 are electrically disconnected, and the supply of the secondary electric current is stopped.

(Effects)

Therefore, according to the second embodiment, as the attaching seat 231 of the movable contact spring 220 is attached to the vertical wall 219*b* of the yoke 219, and the attaching seat 233 of the movable contact terminal 210 is attached to face the arm portion 231*a* of the attaching seat 231 in the short direction of the vertical wall 219*b*, the magnetic field J2 generated in the yoke 219 as the secondary electric current flows between the attaching seats 231 and 233 can be caused to overlap the magnetic field J1 generated in the coil 204 by the primary electric current. Thus, compared to when the magnetic field J2 does not overlap the magnetic field J1, the magnetic force generated in the iron core 218 increases, and the attractive force on the iron piece 225 of the magnetized iron core 218 increases compared to the related art. Thus the bounce occurring between the movable contact 221 and the fixed contact 222 can be suppressed. As a result, the lifespan of the electromagnetic relay 201 can be increased by suppressing the promotion of the contact abrasion.

Further, as the attaching seat 231 of the movable contact spring 220 is formed in a large part of the vertical wall 219*b* of the yoke 219 in the short direction, stiffness of the movable contact spring 220 can be increased. In other words, stiffness of the movable contact spring 220 can be increased such that the installation space of the attaching seat 231 of the movable contact spring 220 repeating elastic deformation is attached to the yoke 219, and then secured to be larger than the movable contact terminal 210 that does not operate. Thus, damage caused by metallic fatigue of the movable contact spring 220 can be reliably prevented, and the lifespan of the electromagnetic relay 201 can be increased.

The present invention is not limited to the second embodiment, and various changes can be made to the second embodiment within the scope not departing from the gist of the present invention.

For example, the second embodiment has been described in connection with the example in which the attaching seat 231 of the movable contact spring 220 is attached to the vertical wall 219*b* of the yoke 219, and the attaching seat 233 of the movable contact terminal 210 is attached to face the arm portion 231*a* of the attaching seat 231 in the short direction of the vertical wall 219*b*. However, the present invention is not limited to this configuration, and the attachment positions of the attaching seat 231 of the movable contact spring 220 and the attaching seat 233 of the movable contact terminal 210 relative to the yoke 219 need only be the positions at which the magnetic field J2 generated in the yoke 219 as the secondary electric current flows between the attaching seats 231 and 233 overlaps the magnetic field J1 generated in the coil 204.

This example will be described. In other words, the description will proceed with an example in which, as the direction of the electric current flowing to the coil wire 215 is opposite to the direction in the second embodiment or the winding direction of the coil wire 215 wound around the coil bobbin 214 is opposite to the direction in the second embodiment, the direction the magnetic field J1 generated in the coil 204 is the direction from the flange portion 218*a* of the iron core 218 toward the upper wall 219*a* of the yoke 219. In this case, in FIG. 11B, the direction of the magnetic field J1 is a counterclockwise direction which is opposite to the direction in the second embodiment. Thus, the attaching seat 233 of the movable contact terminal 210 is arranged to face one of the two arm portions 231*a* and 231*a* forming the attaching seat 231 of the movable contact spring 220, that is, the arm portion 231*a* arranged at the left side in FIG. 9.

Further, the second embodiment has been described in connection with the example in which the attaching seat 231 of the movable contact spring 220 is formed in a large part of the center in the vertical wall 219*b* of the yoke 219 and has an approximately C shape in a planar view. However, the present invention is not limited to this configuration, and the attaching seat 231 of the movable contact spring 220 need only be formed to cause the magnetic field J2 in a certain direction.

Here, the magnetic field J2 is generated on the vertical wall 219*b* of the yoke 219 by the electric current that flows from the welding point P202 set to the attaching seat 233 of the movable contact terminal 210 toward the welding point P201 set to the attaching seat 231 of the movable contact spring 220. Thus, when the distance between the welding points P201 and P202 is secured long, the magnetic flux density of the magnetic field J2 can be increased corresponding to the distance. Thus, the attaching seat 231 of the movable contact spring 220 is preferably formed so that the distance between the welding points P201 and 202 can be secured as long as possible while securing stiffness.

Further, since the magnetic field J2 need only be generated in a certain direction, the attaching seat 233 of the movable contact terminal 210 may be arranged in the attaching seat 231 of the movable contact spring 220.

The details will be described with reference to FIG. 13.

Modified Example

Figure 13:
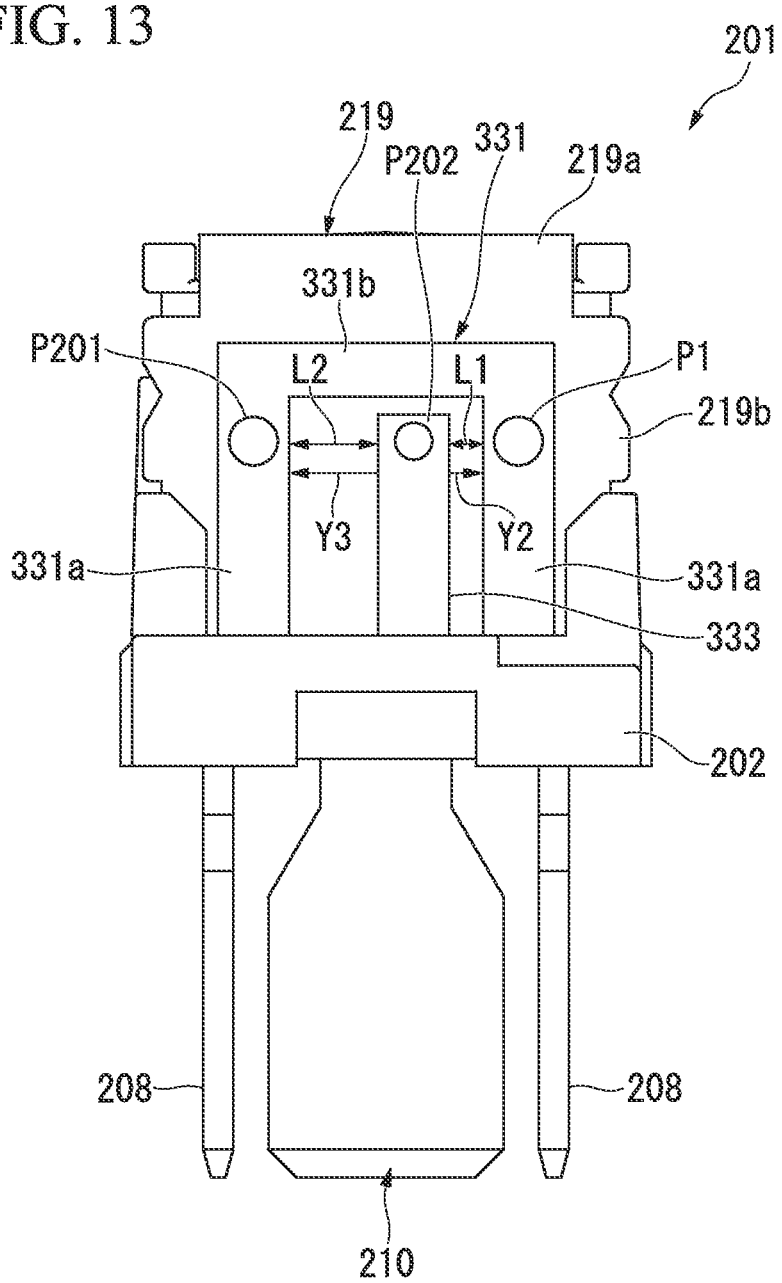
FIG. 13 is a front view of an electromagnetic relay according to a modified example of the second embodiment of the present invention.

FIG. 13 is a front view illustrating a modified example of the electromagnetic relay 201 according to the second embodiment of the present invention, and corresponds to FIG. 9. In the following description, the same components as in the second embodiment are denoted by the same reference numerals, and a description thereof will be omitted.

As illustrated in FIG. 13, an attaching seat 331 of the movable contact spring 220 extends along the outer edge of the vertical wall 219*b* of the yoke 219 and is formed to have an approximately C shape in a planar view. In other words, the attaching seat 331 includes a pair of arm portions 331*a* and 331*a* that extend in the longitudinal direction and are arranged on both sides of the vertical wall 219*b* in the short direction and a connecting unit 331*b* that extends to straddle end portions of the arm portions 331*a* and 331*a* at the side opposite to the base 202 and connects the arm portions 331*a* and 331*a*. The welding points P201 are set to the respective arm portions 331*a* and 331*a* at the connecting unit 331*b* side. The movable contact spring 220 is attached to the vertical wall 219*b* of the yoke 219 by performing spot welding or the like at the welding point P201.

Meanwhile, an attaching seat 333 of the movable contact terminal 210 is formed in the form of a band along the longitudinal direction of the vertical wall 219*b* of the yoke 219 and arranged inside the attaching seat 331 of the movable contact spring 220.

The welding point P202 is set to the front end of the attaching seat 333. The movable contact terminal 210 is attached to the vertical wall 219*b* of the yoke 219 by performing spot welding or the like at the welding point P202.

Here, the attaching seat 333 of the movable contact terminal 210 is not positioned in approximately the center between the pair of the arm portions 331*a* and 331*a* forming the attaching seat 331 of the movable contact spring 220, and is positioned around one arm portion 331*a*, that is, to be slightly rightward from the center in FIG. 13. Thus, a distance L2 from the other arm portion 331*a*, that is, the left arm portion 331*a* in FIG. 13 is set to be larger than a distance L1 between one arm portion 331*a*, that is, the right arm portion 331*a* in FIG. 13 and the attaching seat 333 of the movable contact terminal 210.

In this configuration, as the primary electric current is supplied to the coil 204, the movable contact terminal 210 is electrically connected with the fixed contact terminal 212. As a result, the electric current flows on the vertical wall 219*b* of the yoke 219 between the arm portions 331*a* and 331*a* of the movable contact spring 220 and the attaching seat 333 of the movable contact terminal 210.

More specifically, the electric current flows from the attaching seat 333 toward one arm portion 331*a*, that is, from the right to the left in FIG. 13 (see an arrow Y2 in FIG. 13). Further, the electric current flows from the attaching seat 333 toward the other arm portion 331*a*, that is, from the left to the right in FIG. 13 (see an arrow Y3 in FIG. 13).

Here, the direction of the electric current flowing from the attaching seat 333 toward one arm portion 331*a* is opposite to the direction of the electric current flowing from the attaching seat 333 toward the other arm portion 331*a*, and the two electric currents generate magnetic fields in opposite directions. Thus, the magnetic fields generated by both currents are offset by each other. However, the distance LE between the attaching seat 333 and the other arm portion 331*a* is set to be larger than the distance L1 between the attaching seat 333 and one arm portion 331*a*. Thus, the magnetic field formed by the electric current (see the arrow Y3 in FIG. 13) flowing from the attaching seat 333 toward the other arm portion 331*a* remains. The magnetic field has the same direction as the magnetic field J2 in the second embodiment. Thus, the magnetic field overlaps the magnetic field J1 generated in the coil 204, and the attractive force to the iron piece 225 of the iron core 218 increases.

INDUSTRIAL APPLICABILITY

According to the electromagnetic relay of the present invention, since nitrogen oxide or vapor generated in an internal space can be discharged to the outside through a ventilation hole, the air tightness of the internal space need not be maintained with a high degree of accuracy, and the lifespan of the electromagnetic relay can be increased at a low cost.

REFERENCE SIGNS LIST

1, 201 electromagnetic relay
2 base
3 contact portion
4, 204 coil
7*a*, 9*a*, 11*a* coil terminal slit (terminal slit)
51, 52, 53 concave portion
9 movable contact terminal slit (terminal slit)
11 fixed contact terminal slit (terminal slit)
15, 215 coil wire (coil)
17 cover
18, 218 iron core
21, 221 movable contact
22, 222 fixed contact
41, 42, 43, 141, 142, 143 ventilation hole
A opening area size
Aa total opening area size (opening area size)
K internal space
210 movable contact terminal
212 fixed contact terminal
219 yoke
219*a* upper wall (wall surface)
219*b* vertical wall (wall surface)
220 movable contact spring
225 iron piece
J1, J2 magnetic field

What is claimed is:

1. An electromagnetic relay, comprising:

a base;

an iron core around which a coil is wound;

a yoke which supports the iron core and forms a magnetic path together with the iron core;

a contact portion which is configured with a movable contact and a fixed contact between the base and the coil;

a coil terminal to which the coil is connected;

a fixed contact terminal which is inserted at the base;

a movable contact terminal which is attached to a vertical wall of the yoke; and a movable contact spring which is attached to the vertical wall of the yoke, wherein:

the movable contact spring supports the movable contact of the contact portion, the movable contact spring supports the movable contact such that the movable contact is configured to contact and separate with respect to the fixed contact, the movable contact spring has a first attaching seat attached to the vertical wall of the yoke, and an operating piece that is bent and extends from the first attaching seat to be interposed between the base and the coil, the movable contact is attached to a front end of the operating piece, an iron piece is installed on a surface of the operating piece at the coil side, the operating piece is installed so that the iron piece is separated from the iron core, when the iron core is magnetized as a first electric current is applied to the coil, the operating piece is elastically deformed, the iron piece is adhered onto the iron core, and such that the movable contact comes into contact with the fixed contact and a second electric current is supplied to the fixed contact terminal and the movable contact terminal, the yoke has an upper wall facing the base with a certain gap therebetween, and the vertical wall of the yoke that is bent and extends in a direction approximately vertical to the upper wall, the iron core is fixed to the upper wall and a first end of the movable contact spring, and a first end of the movable contact terminal is fixed to the vertical wall of the yoke so as to be aligned in a short direction of a direction in which the upper wall and the vertical wall of the yoke are connected of the yoke, the movable contact terminal, comprising an external connecting portion, is molded integrally to a second attaching seat attached to the vertical wall of the yoke and the external connecting portion of the movable contact terminal that extends from the second attaching seat toward a side opposite to the yoke while interposing the base, the first attaching seat of the movable contact spring includes a first arm portion that is arranged on a width direction of the vertical wall of the yoke, the second attaching seat of the movable contact terminal includes a second arm portion that is arranged on the width direction of the vertical wall of the yoke, the second arm portion being adjacent to the first arm portion along the width direction of the vertical wall of the yoke, a first welding point, positioned between the vertical wall of the yoke and a first end of the first attaching seat, a second welding point, positioned between the vertical wall of the yoke and a first end of the second attaching seat, and a magnetic field, formed by supplying the second electric current to the fixed contact terminal and the movable contact terminal, is in a same direction as a magnetic field formed by supplying the first electric current to the coil.

2. The electromagnetic relay according to claim 1, wherein the first end of the movable contact spring is formed in a large part of a center in a short direction of the vertical wall of the yoke, and the movable contact terminal is arranged at a first side of the vertical wall of the yoke in the short direction of the vertical wall of the yoke.

3. An electromagnetic relay, comprising:

a base;

an iron core around which a coil is wound;

a yoke which supports the iron core and forms a magnetic path together with the iron core;

a contact portion which is configured with a movable contact and a fixed contact between the base and the coil;

a coil terminal to which the coil is connected;

a fixed contact terminal which is inserted at the base;

a movable contact terminal which is attached to a vertical wall of the yoke; and a movable contact spring which is attached to the vertical wall of the yoke, wherein:

the movable contact spring supports the movable contact of the contact portion, the movable contact spring supports the movable contact such that the movable contact is configured to contact and separate with respect to the fixed contact, the movable contact spring has a first attaching seat attached to the vertical wall of the yoke, and an operating piece that is bent and extends from the first attaching seat to be interposed between the base and the coil, the movable contact is attached to a front end of the operating piece, an iron piece is installed on a surface of the operating piece at the coil side, the operating piece is installed so that the iron piece is separated from the iron core, when the iron core is magnetized as a first electric current is applied to the coil, the operating piece is elastically deformed, the iron piece is adhered onto the iron core, and such that the movable contact comes into contact with the fixed contact and a second electric current is supplied to the fixed contact terminal and the movable contact terminal, the yoke has an upper wall facing the base with a certain gap therebetween, and the vertical wall of the yoke that is bent and extends in a direction approximately vertical to the upper wall, the iron core is fixed to the upper wall and a first end of the movable contact spring, and a first end of the movable contact terminal is fixed to the vertical wall of the yoke so as to be aligned in a short direction of a direction in which the upper wall and the vertical wall of the yoke are connected of the yoke, the movable contact terminal, comprising an external connecting portion, is molded integrally to a second attaching seat attached to the vertical wall of the yoke and the external connecting portion of the movable contact terminal that extends from the second attaching seat toward a side opposite to the yoke while interposing the base, the first attaching seat of the movable contact spring includes a pair of first arm portions that are arranged on both sides of the vertical wall of the yoke in the short direction of the yoke and a connecting unit that extends to straddle end portions of the first arm portions at a side opposite to the base and connects the first arm portions, the second attaching seat of the movable contact terminal is arranged inside the first attaching seat of the movable contact spring and includes a second arm portion that is positioned around one first arm portion between the pair of the first arm portions, a first welding point, positioned between the vertical wall of the yoke and a first end of the first attaching seat, the first welding point located at one arm portion of the pair of the first arm portions, a second welding point, positioned between the vertical wall of the yoke and a first end of the second attaching seat, the second welding point located at the second arm portion, and a magnetic field, formed by supplying the second electric current to the fixed contact terminal and the movable contact terminal, is in a same direction as a magnetic field formed by supplying the first electric current to the coil.

* * * * *